US008619092B2

(12) United States Patent
Yamauchi

(10) Patent No.: US 8,619,092 B2
(45) Date of Patent: Dec. 31, 2013

(54) IMAGE PROCESSING APPARATUS AND GRAPHICS MEMORY UNIT

(75) Inventor: Hideaki Yamauchi, Kawasaki (JP)

(73) Assignee: Fujitsu Semiconductor Limited, Yokohama (JP)

( * ) Notice: Subject to any disclaimer, the term of this patent is extended or adjusted under 35 U.S.C. 154(b) by 1976 days.

(21) Appl. No.: 11/520,704

(22) Filed: Sep. 14, 2006

(65) Prior Publication Data

US 2007/0009182 A1 Jan. 11, 2007

Related U.S. Application Data

(63) Continuation of application No. PCT/JP2004/005819, filed on Apr. 22, 2004.

(51) Int. Cl.

| | |
|---|---|
| ***G09G 5/02*** | (2006.01) |
| ***G09G 5/36*** | (2006.01) |
| ***G09G 5/00*** | (2006.01) |

(52) U.S. Cl.

USPC ..... 345/592; 345/556; 345/629

(58) Field of Classification Search

USPC ..... 345/421, 530, 536, 545, 556, 592, 629

See application file for complete search history.

(56) References Cited

U.S. PATENT DOCUMENTS

| | | | | |
|---|---|---|---|---|
| 4,825,391 | A * | 4/1989 | Merz | 345/589 |
| 4,982,343 | A * | 1/1991 | Hourvitz et al. | 345/592 |
| 5,487,145 | A * | 1/1996 | Marsh et al. | 345/501 |

FOREIGN PATENT DOCUMENTS

| | | | |
|---|---|---|---|
| JP | 62-024369 | A | 2/1987 |
| JP | 4-045487 | A | 2/1992 |
| JP | 5-225328 | A | 9/1993 |
| JP | 10-124038 | A | 5/1998 |
| JP | 2000-032334 | A | 1/2000 |
| JP | 2000-057317 | A | 2/2000 |
| JP | 2000-066659 | A | 3/2000 |
| JP | 2000-235643 | A | 8/2000 |
| JP | 2000-259822 | A | 9/2000 |

* cited by examiner

*Primary Examiner* — Joni Richer

(74) *Attorney, Agent, or Firm* — Fujitsu Patent Center

(57) ABSTRACT

An image processing apparatus and graphics memory unit which reduces useless memory access to a graphics memory unit. When an image data read section reads image data from frame buffers or windows, a mask area inside/outside determination section determines by reference to mask information stored in a mask information storage section whether image data which is being scanned is in a memory access mask area. If the image data which is being scanned is in the memory access mask area, then a superposition process section performs a superposition process according to a transmission attribute assigned to the memory access mask area regardless of transmission attributes assigned to the frame buffers or the windows.

9 Claims, 26 Drawing Sheets

| | COORDINATES OF PIXEL WHICH IS BEING SCANNED AT MOMENT | | | |
|---|---|---|---|---|
| | PIXEL COORDINATES 421 | PIXEL COORDINATES 422 | PIXEL COORDINATES 423 | PIXEL COORDINATES 424 |
| FIRST-LAYER MASK CONTROL SECTION<br>MASK AREA INSIDE/OUTSIDE DETERMINATION RESULT | OUTSIDE MASK AREA | IN MASK AREA 411 | IN MASK AREA 411 | OUTSIDE MASK AREA |
| TEMPORARY TRANSMISSION ATTRIBUTE | TRANSMISSION ATTRIBUTE OF FRAME BUFFER | TRANSPARENT | TRANSPARENT | TRANSMISSION ATTRIBUTE OF FRAME BUFFER |
| SECOND-LAYER MASK CONTROL SECTION<br>MASK AREA INSIDE/OUTSIDE DETERMINATION RESULT | OUTSIDE MASK AREA | OUTSIDE MASK AREAS | IN MASK AREA 414 | IN MASK AREA 415 |
| TEMPORARY TRANSMISSION ATTRIBUTE | TRANSMISSION ATTRIBUTE OF FRAME BUFFER | TRANSMISSION ATTRIBUTE OF FRAME BUFFER | OPAQUE | OPAQUE |

FIG. 14

MASK INFORMATION STORAGE SECTION FOR MASK AREA 434

| |
|---|
| MASK AREA SETTING REGISTER COORDINATES WHICH DEFINE UPPER LEFT-HAND CORNER: (x9a, y9a) COORDINATES WHICH DEFINE LOWER RIGHT-HAND CORNER: (x9b, y9b) |
| MASK TRANSMISSION ATTRIBUTE SETTING REGISTER: OPAQUE |
| MASK PRIORITY SETTING REGISTER: HIGHEST PRIORITY |

MASK INFORMATION STORAGE SECTION FOR MASK AREA 435

| |
|---|
| MASK AREA SETTING REGISTER COORDINATES WHICH DEFINE UPPER LEFT-HAND CORNER: (x10a, y10a) COORDINATES WHICH DEFINE LOWER RIGHT-HAND CORNER: (x10b, y10b) |
| MASK TRANSMISSION ATTRIBUTE SETTING REGISTER: OPAQUE |
| MASK PRIORITY SETTING REGISTER: HIGHEST PRIORITY |

MASK INFORMATION STORAGE SECTION FOR MASK AREA 436

| |
|---|
| MASK AREA SETTING REGISTER COORDINATES WHICH DEFINE UPPER LEFT-HAND CORNER: (x11a, y11a) COORDINATES WHICH DEFINE LOWER RIGHT-HAND CORNER: (x11b, y11b) |
| MASK TRANSMISSION ATTRIBUTE SETTING REGISTER: OPAQUE |
| MASK PRIORITY SETTING REGISTER: SECOND PRIORITY |

MASK INFORMATION STORAGE SECTION FOR MASK AREA 437

| |
|---|
| MASK AREA SETTING REGISTER COORDINATES WHICH DEFINE UPPER LEFT-HAND CORNER: (x12a, y12a) COORDINATES WHICH DEFINE LOWER RIGHT-HAND CORNER: (x12b, y12b) |
| MASK TRANSMISSION ATTRIBUTE SETTING REGISTER: TRANSPARENT |
| MASK PRIORITY SETTING REGISTER: HIGHEST PRIORITY |

FIG. 18

| | COORDINATES OF PIXEL WHICH IS BEING SCANNED AT MOMENT | | | |
|---|---|---|---|---|
| | PIXEL COORDINATES 441 | PIXEL COORDINATES 442 | PIXEL COORDINATES 443 | PIXEL COORDINATES 444 |
| FIRST-LAYER MASK CONTROL SECTION<br>MASK AREA INSIDE/OUTSIDE DETERMINATION RESULT | IN MASK AREAS 431 AND 432 | IN MASK AREA 431 | IN MASK AREA 431 | IN MASK AREAS 431 AND 433 |
| MASK AREA ADOPTED BY PRIORITY DETERMINATION | MASK AREA 432 | MASK AREA 431 | MASK AREA 431 | MASK AREA 433 |
| TEMPORARY TRANSMISSION ATTRIBUTE | SEMITRANSPARENT | TRANSPARENT | TRANSPARENT | SEMITRANSPARENT |
| SECOND-LAYER MASK CONTROL SECTION<br>MASK AREA INSIDE/OUTSIDE DETERMINATION RESULT | OUTSIDE MASK AREAS | IN MASK AREAS 434 AND 435 | IN MASK AREAS 436 AND 437 | IN MASK AREA 436 |
| MASK AREA ADOPTED BY PRIORITY DETERMINATION | NO | MASK AREA 434 | MASK AREA 437 | MASK AREA 436 |
| TEMPORARY TRANSMISSION ATTRIBUTE | TRANSMISSION ATTRIBUTE OF FRAME BUFFER | OPAQUE | TRANSPARENT | OPAQUE |

FIG. 22

IMAGE PROCESSING APPARATUS AND GRAPHICS MEMORY UNIT

This application is a continuing application, filed under 35 U.S.C. §111(a), of International Application PCT/JP2004/005819, filed Apr. 22, 2004.

BACKGROUND OF THE INVENTION

1. Field of the Invention

This invention relates to an image processing apparatus and a graphics memory unit and, more particularly, to an image processing apparatus for reading image data stored in a plurality of frame buffers each of which corresponds to one layer and for superimposing and displaying the image data and a graphics memory unit for storing the image data.

2. Description of the Related Art

Conventional techniques for superimposing a plurality of windows and showing them on a display unit are divided broadly into the following two methods. A first method is to draw or copy an image for each window into a single-layer frame buffer made up of a single buffer and a double buffer, to write colors into the image, to read the result, and to output it to a display unit. This method is adopted in window systems on personal computers and workstations, video game machines, and the like. A second method is to read and superimpose image data stored in a frame buffer which corresponds to a plurality of layers and which is secured in, for example, a graphics memory and to output it to a display unit. This method is adopted in car navigation systems, display systems included in built-in systems in, for example, industrial-use equipment, and the like.

Even if a single-layer frame buffer included in a personal computer or a workstation in which the first method is adopted stores a plurality of windows, usually these windows are opaque and are independent of one another. Accordingly, only by automatically detecting areas in which two windows overlap, the function of inhibiting the useless drawing of pixels which are concealed by the upper-layer window and which are not visible on the lower-layer window can be realized. In addition, usually each frame must be redrawn in 3-D CG. Therefore, even if a menu, a score, or the like is semitransparently displayed on top on a video game machine, the method of copying each frame of a window into a single-layer frame buffer and synthesizing it is not useless.

In a car navigation system in which the second method is adopted, on the other hand, cases where there are an opaque area, a transparent area, and a semitransparent area in a window are not rare. In addition, a window which belongs to a lower-layer frame buffer may be seen through an upper layer, so pixels on the lower-layer window must be read from a graphics memory without omission.

With content such as a two-dimensional map, each frame is not redrawn and the technique of reusing many frames by scrolling a drawn screen is often used. If the method of copying each frame of a window into a single-layer frame buffer and synthesizing it is used, a screen cannot be reused. Therefore, the technique of distributing individual windows among frame buffers at different layers, performing drawing and scrolling according to layers, and superimposing and color-mixing each layer on the graphics LSI (large scale integration circuit) side just before displaying on a display unit is adopted.

Furthermore, in the second method the technique of giving the attribute "transparent," "opaque," or "semitransparent" or a transmission value according to frame buffers at different layers or windows and switching a superposition and color-mixing method according to attributes or transmission values is disclosed (see, for example, Japanese Unexamined Patent Publication No. 4-45487). The technique of switching the attribute "transparent," "opaque," or "semitransparent" or a transmission value according to pixels of each layer and performing a close superposition and color-mixing process like gradation is also disclosed (see, for example, Japanese Unexamined Patent Publication No. 5-225328).

However, an image in a window located on an upper layer may include, for example, an opaque area, a transparent area, and a semitransparent area. With the technique of setting the uniform transmission attribute "opaque," "transparent," or "semitransparent" according to windows, the transmission attribute of the window must be set to "semitransparent" in order to properly display the semitransparent area. As a result, though there is no need to read pixels on a lower layer corresponding to pixel coordinates in the opaque area included in the image in the window located on the upper layer, these useless pixels are read unconditionally. Conversely, only pixels on the lower layer corresponding to pixel coordinates in the transparent area included in the image in the window located on the upper layer should be read. Though there is no need to read pixels in the transparent area included in the image in the window located on the upper layer, these useless pixels are read unconditionally.

With the technique of setting the transmission attribute "opaque," "transparent," or "semitransparent" or a transmission value according to pixels, a transmission attribute or a transmission value must unconditionally be determined one pixel at a time regardless of the distribution of the opaque area, the transparent area, and the semitransparent area in the image in the window located on the upper layer. As a result, though there is no need to read the pixels on the lower layer corresponding to the pixel coordinates in the opaque area included in the image in the window located on the upper layer, these useless pixels are read unconditionally. Conversely, only pixels on the lower layer corresponding to pixel coordinates in the transparent area included in the image in the window located on the upper layer should be read. Though there is no need to read pixels in the transparent area included in the image in the window located on the upper layer, these useless pixels are read unconditionally.

SUMMARY OF THE INVENTION

The present invention was made under the background circumstances described above. An object of the present invention is to provide an image processing apparatus that can reduce useless memory access to a graphics memory unit.

In order to solve the above problems, there is provided an image processing apparatus for reading image data stored in a plurality of frame buffers each of which corresponds to one layer and for superimposing and displaying the image data. This image processing apparatus comprises an image data read section for reading the image data from the plurality of frame buffers to which transmission attributes are assigned or windows which belong to the plurality of frame buffers and to which transmission attributes are assigned by scanning; a mask information storage section for storing mask information for memory access mask areas which are defined on the plurality of frame buffers or the windows and to which independent transmission attributes are assigned; a mask area inside/outside determination section for determining by reference to the mask information whether image data which is being scanned is in one of the memory access mask areas; and a superposition process section for performing, in the case of the image data which is being scanned being in a memory access mask area, a superposition process according to a transmission attribute assigned to the memory access mask area regardless of the transmission attributes assigned to the plurality of frame buffers or the windows.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 14 shows the result of determination made by a mask control section.

FIG. 18 shows mask information stored in the second-layer mask information storage section.

FIG. 22 shows the result of determination made by the mask control section.

DESCRIPTION OF THE PREFERRED EMBODIMENTS

Embodiments of the present invention will now be described in detail with reference to the drawings.

Figure 1:
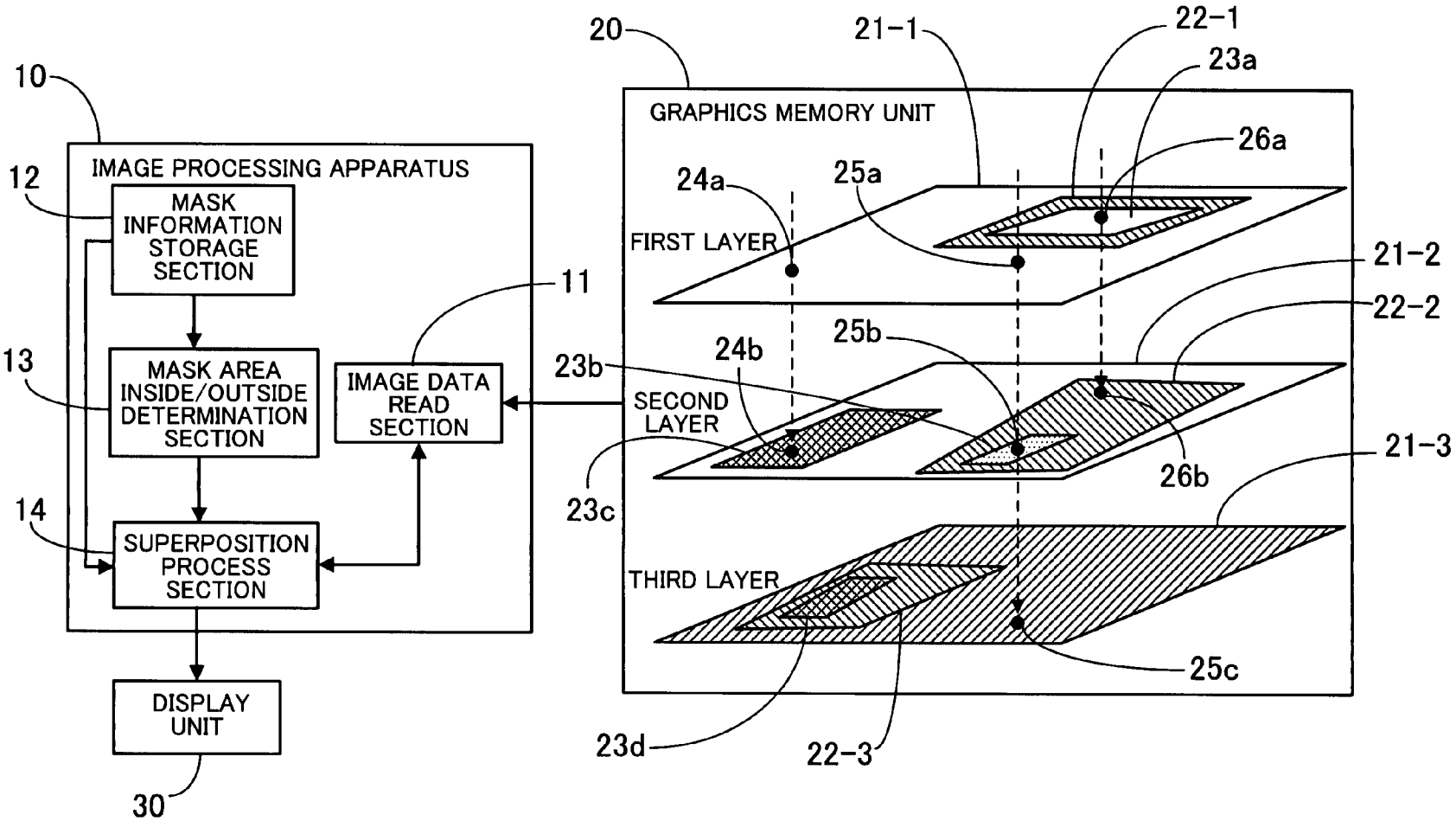
FIG. 1 is a view showing the principles underlying an image processing apparatus and a graphics memory unit according to an embodiment of the present invention.

FIG. 1 is a view showing the principles underlying an image processing apparatus and a graphics memory unit according to an embodiment of the present invention.

The image processing apparatus 10 according to an embodiment of the present invention reads image data (hereinafter also referred to as "image data for a pixel" or "pixel") stored in the frame buffers 21-1, 21-2, and 21-3 in a graphics memory unit 20, such as a video random access memory (VRAM), each of which corresponds to one layer, and superimposes and displays the image data. The image processing apparatus 10 comprises the image data read section 11, the mask information storage section 12, the mask area inside/outside determination section 13, and the superposition process section 14.

The image data read section 11 reads image data from the frame buffers 21-1, 21-2, and 21-3 to which transmission attributes, such as "transparent," "semitransparent," and "opaque," are assigned or the windows 22-1, 22-2, and 22-3 which belong to the frame buffers 21-1, 21-2, and 21-3 respectively and to which transmission attributes, such as "transparent," "semitransparent," or "opaque," are assigned by scanning.

The windows 22-1, 22-2, and 22-3 are areas smaller than screen areas stored in the frame buffers 21-1, 21-2, and 21-3. Uniform transmission attributes are set according to windows or transmission attributes are set according to pixels. In this example, each layer includes one window. However, the number of windows at each layer may be greater or smaller than one. In addition, to simplify description, each of the frame buffers 21-1, 21-2, and 21-3 corresponds to one layer and there are three layers. However, the number of layers may be two or greater than three.

The mask information storage section 12 stores mask information for the memory access mask areas (hereinafter referred to as "mask areas" for short) 23*a*, 23*b*, 23*c*, and 23*d* which are defined on the frame buffers 21-1, 21-2, and 21-3 or the windows 22-1, 22-2, and 22-3 and to which independent transmission attributes are assigned. It may safely be said that each of the mask areas 23*a*, 23*b*, 23*c*, and 23*d* is an area in image data at one layer having the same transmission attribute.

The mask areas 23*a*, 23*b*, 23*c*, and 23*d* are defined on the frame buffers 21-1, 21-2, and 21-3 or the windows 22-1, 22-2, and 22-3. More than one mask area may be set in one window. Mask information includes the transmission attributes, sizes, positions, priority (described later) of the mask areas 23*a*, 23*b*, 23*c*, and 23*d*. This mask information is stored in the mask information storage section 12 before the image processing apparatus 10 reads image data from the frame buffers 21-1, 21-2, and 21-3.

The mask area inside/outside determination section 13 refers to the mask information and determines whether the image data which is being scanned by the image data read section 11 is in the mask area 23*a*, 23*b*, 23*c*, or 23*d*.

If the image data which is being scanned is in the mask area 23*a*, 23*b*, 23*c*, or 23*d*, then the superposition process section 14 performs a superposition process according to the transmission attribute assigned to the mask area 23*a*, 23*b*, 23*c*, or 23*d* regardless of the transmission attributes assigned to the frame buffers 21-1, 21-2, and 21-3 or the windows 22-1, 22-2, and 22-3. If the image data which is being scanned is outside the mask areas 23*a*, 23*b*, 23*c*, and 23*d*, then the superposition process section 14 performs a superposition process according to the transmission attributes of the frame buffers 21-1, 21-2, and 21-3 or the windows 22-1, 22-2, and 22-3 to which the image data read belongs. Data obtained by performing the superposition process is outputted to a display unit 30 and is displayed thereon. Information (not shown) including the transmission attributes, the sizes, the positions, and the order of superposition of the frame buffers 21-1, 21-2, and 21-3 or the windows 22-1, 22-2, and 22-3 is stored in advance in the image processing apparatus 10.

The operation of the image processing apparatus 10 will now be described.

Descriptions will be given with the frame buffer 21-1 (first layer), the frame buffer 21-2 (second layer), and the frame buffer 21-3 (third layer) as the highest layer, a middle layer, and the lowest layer respectively.

It is assumed that the transmission attributes of the frame buffers 21-1 and 21-2 are uniform and transparent and that the transmission attribute of the frame buffer 21-3 is uniform and opaque. It is assumed that the transmission attributes of the windows 22-1, 22-2, and 22-3 are opaque. In addition, it is assumed that the mask areas 23*a*, 23*b*, 23*c*, and 23*d* are transparent, semitransparent, opaque, and opaque respectively.

When the image data read section 11 reads image data from the frame buffers 21-1, 21-2, and 21-3 or the windows 22-1, 22-2, and 22-3, the mask area inside/outside determination section 13 refers to the mask information stored in the mask information storage section 12 and determines whether the image data which is being scanned is in the mask area 23*a*, 23*b*, 23*c*, or 23*d*. If the image data which is being scanned is in the mask area 23*a*, 23*b*, 23*c*, or 23*d*, then the superposition process section 14 performs a superposition process according to the transmission attribute assigned to the mask area 23*a*, 23*b*, 23*c*, or 23*d* regardless of the transmission attributes assigned to the frame buffers 21-1, 21-2, and 21-3 or the windows 22-1, 22-2, and 22-3. If the image data which is being scanned is outside the mask areas 23*a*, 23*b*, 23*c*, and 23*d*, then the superposition process section 14 performs a superposition process by referring to the transmission attributes of the frame buffers 21-1, 21-2, and 21-3 or the windows 22-1, 22-2, and 22-3, and outputs data obtained as a result of the superposition process to the display unit 30.

A concrete description will be given with the case where one pixel is drawn by reading image data for the corresponding pixels from the frame buffers 21-1, 21-2, and 21-3 in that order and by performing a superposition process as an example. A pixel 24*a* at the highest layer which is being scanned by the image data read section 11 is outside the mask area 23*a* and the transmission attribute of the frame buffer 21-1 is transparent. Accordingly, the image data read section 11 does not read the pixel 24*a*. A pixel 24*b* at the middle layer the coordinates of which correspond to the pixel 24*a* is in the mask area 23*c*, so the transmission attribute of the mask area 23*c* is referred to regardless of the transmission attribute of the frame buffer 21-2 which is the middle layer. The transmission attribute of the mask area 23*c* is opaque, so the image data read section 11 does not read a pixel in the frame buffer 21-3, being the lowest layer, or the window 22-3 the position of which corresponds to the pixel 24*b*. As a result, the superposition process section 14 does not perform a superposition process using image data stored in the frame buffer 21-3, being the lowest layer, and outputs the pixel 24*b*. Similarly, a pixel 25*a* at the highest layer is outside the mask area 23*a* and the transmission attribute of the frame buffer 21-1 is transparent. Accordingly, the image data read section 11 does not read the pixel 25*a*. A pixel 25*b* at the middle layer the coordinates of which correspond to the pixel 25*a* is in the mask area 23*b*, so the transmission attribute of the mask area 23*b* is referred to regardless of the transmission attribute of the window 22-2 in which the mask area 23*b* is defined. The transmission attribute of the mask area 23*b* is semitransparent, so the superposition process section 14 performs a process for mixing the colors of the pixel 25*b* and a pixel 25*c* in the frame buffer 21-3, being the lowest layer, the coordinates of which correspond to the pixels 25*a* and 25*b*, and outputs data obtained as a result of the process. A pixel 26*a* at the highest layer is in the mask area 23*a*, so the transmission attribute of the mask area 23*a* is referred to regardless of the transmission attribute of the window 22-1 in which the mask area 23*a* is defined. The transmission attribute of the mask area 23*a* is transparent, so the image data read section 11 does not read the pixel 26*a*. A pixel 26*b* at the middle layer the coordinates of which correspond to the pixel 26*a* is outside the mask area 23*b* and belongs to the window 22-2. The transmission attribute of the window 22-2 is opaque. Accordingly, the image data read section 11 does not read image data at the lowest layer and the superposition process section 14 outputs the pixel 26*b*.

To explain the principles underlying the present invention, the descriptions of the superposition process performed from the highest layer have been given. A color mixing process involving normal superposition performed from the lowest layer will be described later.

As stated above, by using the image processing apparatus 10 according to the embodiment of the present invention, memory access for reading image data can be limited to a specific area in a frame buffer or a window at each layer. The image processing apparatus 10 has the following advantage, especially if a superposition process is performed from the highest layer. To draw a pixel, the image data read section 11 reads image data at the highest layer corresponding to the pixel first, then image data at the middle layer corresponding to the pixel, and then image data at the lowest layer corresponding to the pixel. The image data read section 11 does not read image data at a layer lower than a layer the transmission attribute of which is opaque from the mask information. In addition, the superposition process section 14 does not superimpose the image data at the layer lower than the layer the transmission attribute of which is opaque from the mask information. This reduces useless memory access and improves efficiency in the use of memory bandwidth.

The embodiment of the present invention will now be described in detail.

Figure 2:
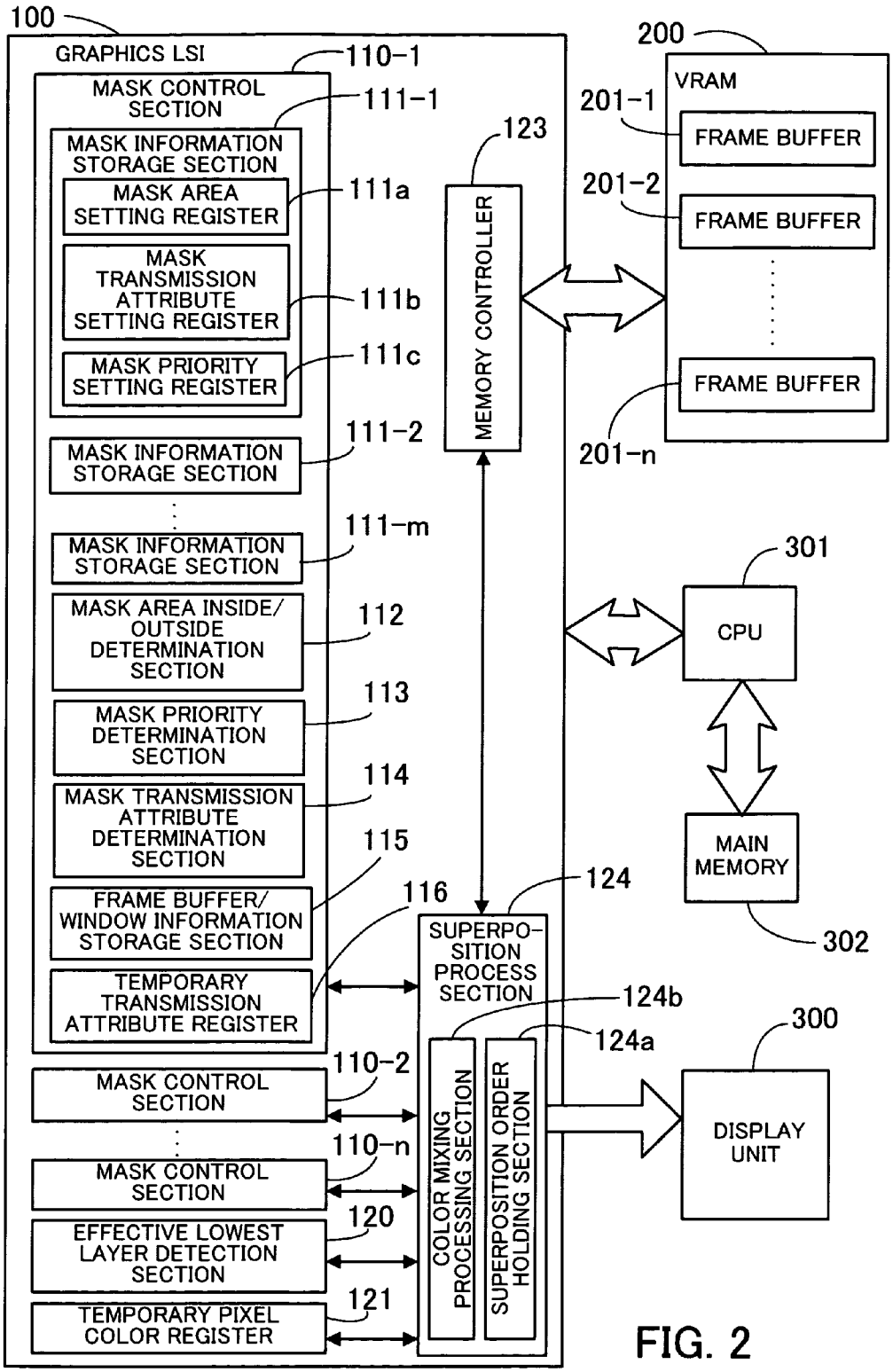
FIG. 2 shows an example of the structure of an image processing system.

FIG. 2 shows an example of the structure of an image processing system.

An image processing system shown in FIG. 2 comprises a graphics LSI 100, a VRAM 200, a display unit 300, a central processing unit (CPU) 301 for controlling the graphics LSI 100, and a main memory 302 where the CPU 301 operates.

The graphics LSI 100 includes mask control sections 110-1, 110-2, . . . , 110-*n* corresponding to a plurality of layers, an effective lowest layer detection section 120 for detecting an effective lowest layer, a temporary pixel color register 121 for holding a temporary pixel color, a memory controller 123, and a superposition process section 124.

Each of the mask control sections 110-1, 110-2, . . . , **110-*n* includes mask information storage sections 111-1, 111-2, . . . , and 111-*m* for storing information for a plurality of mask areas, a mask area inside/outside determination section 112, a mask priority determination section 113 described later, a mask transmission attribute determination section 114 for determining the transmission attribute of a mask area, a frame buffer/window information storage section 115 for storing information such as the transmission attribute, position, and size of a frame buffer or a window, and a temporary transmission attribute register 116** for holding the temporary transmission attribute of a layer.

Each of the mask information storage sections 111-1 through **111-*m* includes a mask area setting register 111*a* in which a mask area is set, a mask transmission attribute setting register 111*b* in which the transmission attribute of a mask area is set, and a mask priority setting register 111*c*** in which a mask priority described later is set.

The superposition process section 124 includes a superposition order holding section **124*a* for holding the order in which layers are superimposed, and a color mixing process section 124*b*** for performing a color mixing process.

Frame buffers 201-1, 201-2, . . . , **201-*n* corresponding to the plurality of layers are secured in the VRAM 200**.

The graphics LSI 100 reads image data from the frame buffers 201-1 through **201-*n*, performs a superposition process, and outputs a result to a display unit 300. The display unit 300** is a liquid crystal display (LCD), a cathode ray tube (CRT), or the like.

The graphics LSI 100 corresponds to the image processing apparatus 10 shown in FIG. 1 and the memory controller 123 carries out the function of the image data read section 11. In FIG. 2, the functions of the mask information storage section 12 and the mask area inside/outside determination section 13 shown in FIG. 1 are included in the mask control sections 110-1 through **110-*n* corresponding to the plurality of layers. The VRAM 200 corresponds to the graphics memory unit 20 shown in FIG. 1**.

Next, the operation of the graphics LSI 100 will be described.

The process for reading image data from frame buffers 201-1 through 201-3 which correspond to three layers and which are secured in the VRAM 200 and for displaying an image obtained by superimposing the image data will be described.

Figure 3:
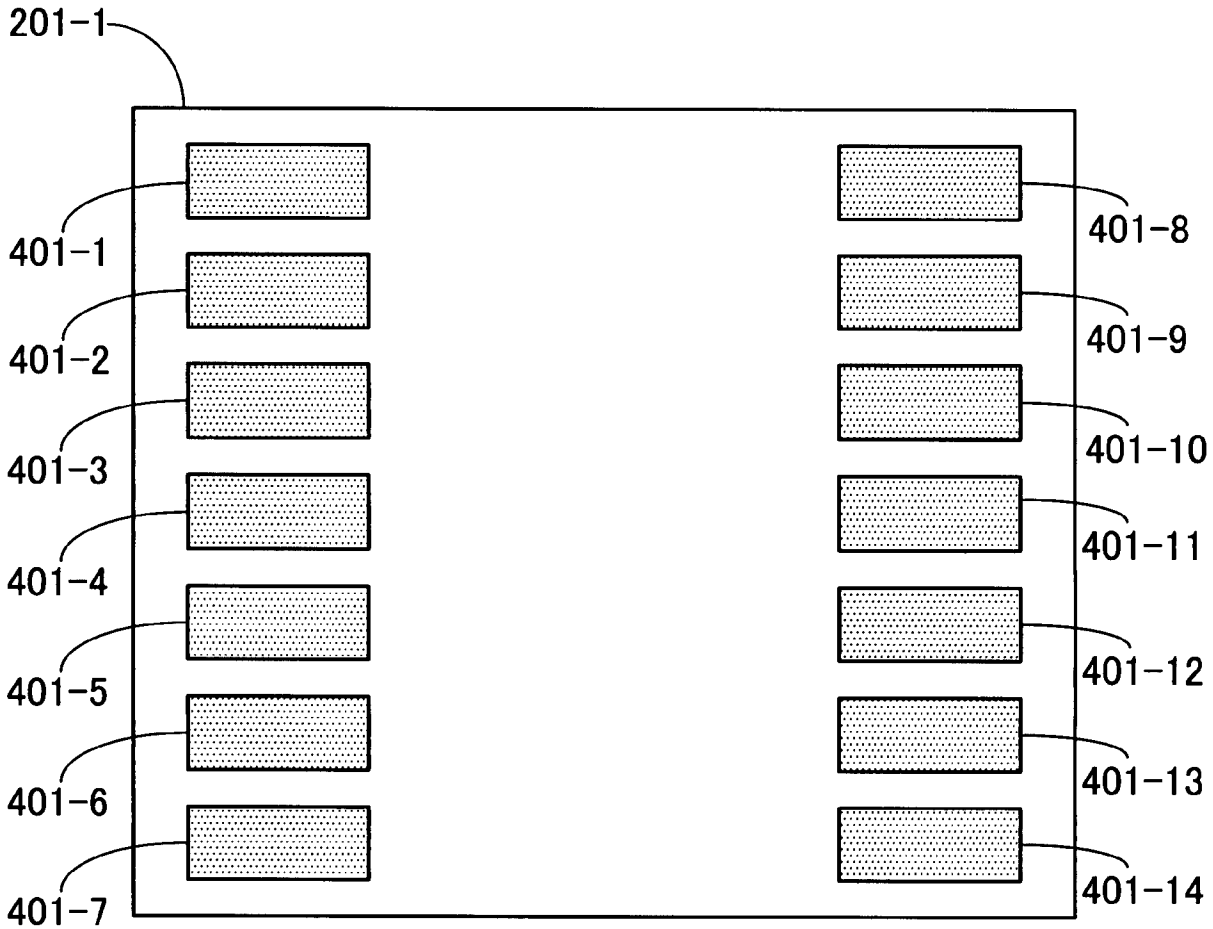
FIG. 3 is a schematic view showing an example of image data stored in a first-layer frame buffer.
Figure 4:
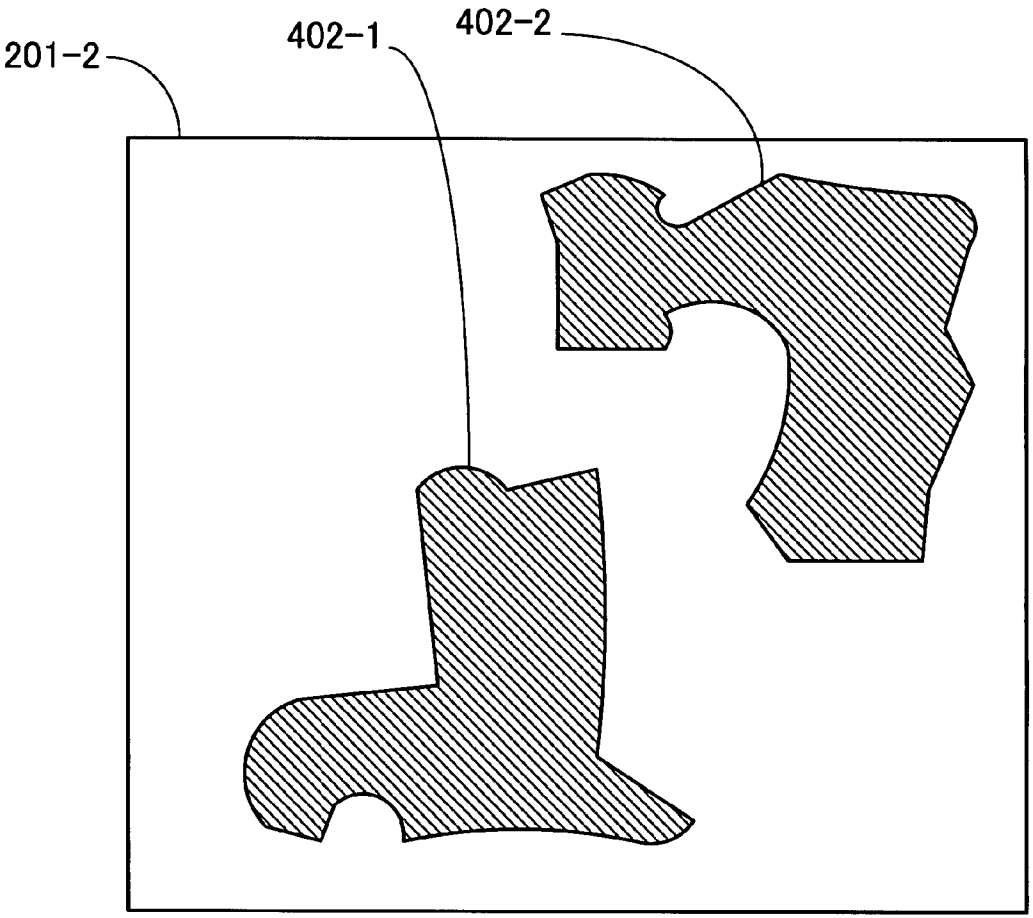
FIG. 4 is a schematic view showing an example of image data stored in a second-layer frame buffer.
Figure 5:
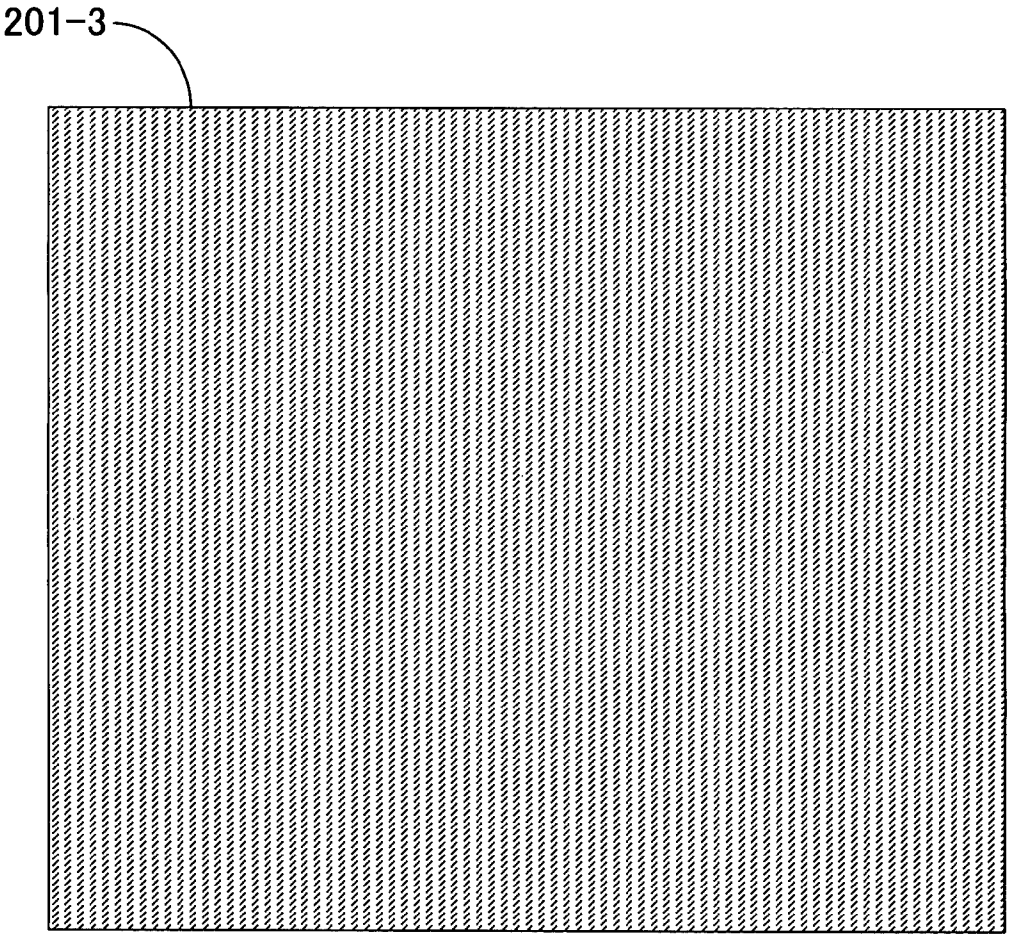
FIG. 5 is a schematic view showing an example of image data stored in a third-layer frame buffer.

FIGS. 3 through 5 are schematic views showing examples of image data stored in the frame buffers which correspond to the three layers and which are secured in the VRAM 200. FIG. 3 is a schematic view showing an example of image data stored in a first-layer frame buffer. FIG. 4 is a schematic view showing an example of image data stored in a second-layer frame buffer. FIG. 5 is a schematic view showing an example of image data stored in a third-layer frame buffer.

Image data in the first-layer frame buffer 201-1 shown in FIG. 3 includes buttons 401-1, 401-2, . . . , 401-14. Image data in the second-layer frame buffer 201-2 shown in FIG. 4 includes two figures 402-1 and 402-2. Image data in the third-layer frame buffer 201-3 shown in FIG. 5 is used as, for example, a background. The frame buffers 201-1 through 201-3 may be considered as windows.

Figure 6:
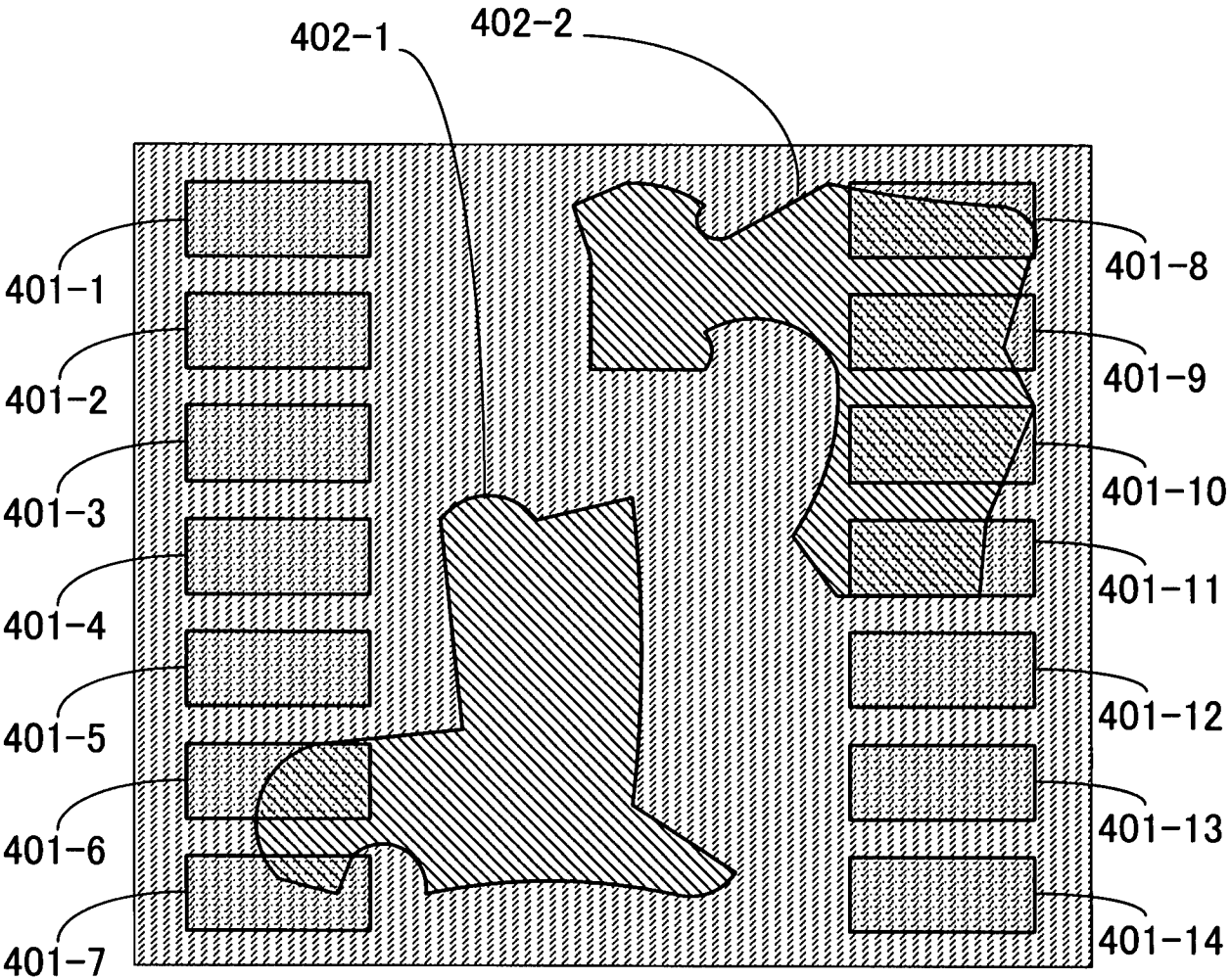
FIG. 6 is a schematic view showing an image obtained by superimposing the image data stored in the first-layer, second-layer, and third-layer frame buffers.

FIG. 6 is a schematic view showing an image obtained by superimposing the image data stored in the first-layer, second-layer, and third-layer frame buffers.

In this case, the buttons 401-1 through 401-14 at the first layer are semitransparent, the figures 402-1 and 402-2 at the second layer are opaque, and the image data at the third layer is opaque.

The process for displaying the image shown in FIG. 6 will now be described.

Figure 7:
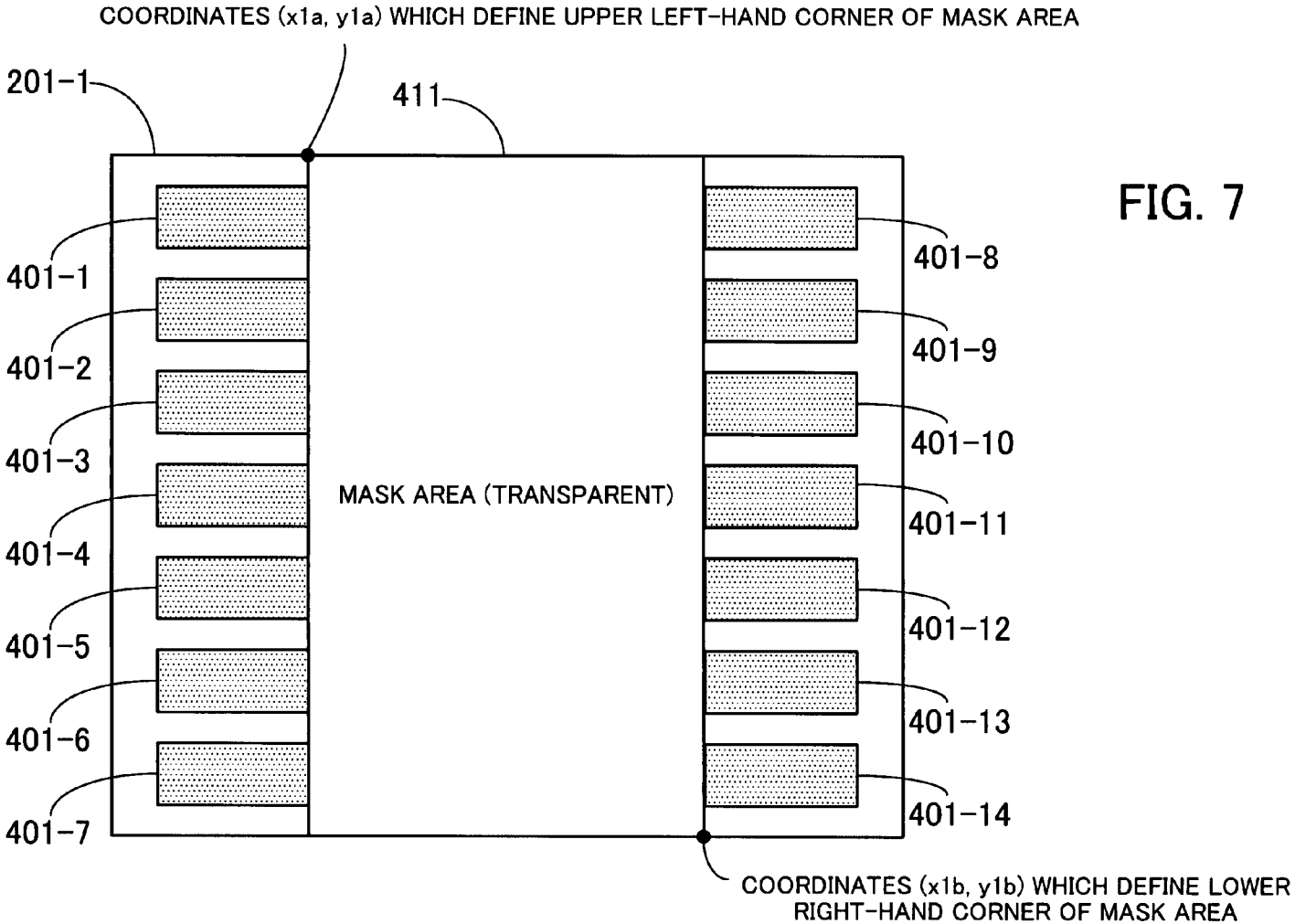
FIG. 7 is a schematic view showing a superposition of the image data stored in the first-layer frame buffer and a mask area.
Figure 8:
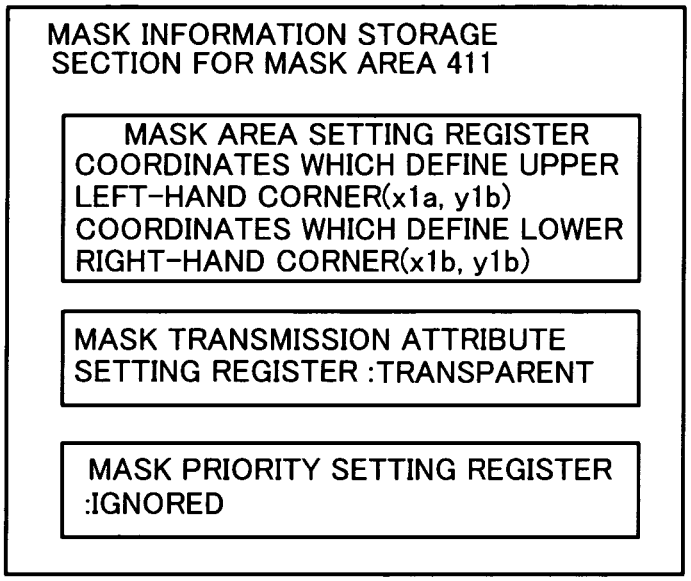
FIG. 8 shows mask information stored in a first-layer mask information storage section.

FIG. 7 is a schematic view showing a superposition of the image data stored in the first-layer frame buffer and a mask area. FIG. 8 shows mask information stored in a first-layer mask information storage section.

A mask area 411 is set by using a figure such as a rectangle. The position of the mask area 411 is defined by the coordinates of vertices of the figure. As shown in FIG. 7, the mask area 411 is located in parallel with horizontal and vertical coordinate axes of the frame buffer 201-1 and the position and shape of the mask area 411 are defined by using the horizontal and vertical coordinates of opposite vertices of the mask area 411. By doing so, the position and size of the mask area 411 can be determined only by a combination of four numeric values. In this example, an image data area at the first layer which the graphics LSI 100 does not need to read is designated by the mask area 411, so the transmission attribute of the mask area 411 is transparent.

This mask area 411 is set in advance for the frame buffer 201-1. As shown in FIG. 8, mask information for the mask area 411 is stored in a mask information storage section in the graphics LSI 100. That is to say, coordinates which define the upper left-hand corner of the mask area 411 and coordinates which define the lower right-hand corner of the mask area 411 are stored in a mask area setting register and the transmission attribute of the mask area 411 is stored in a mask transmission attribute setting register (in this example, a mask priority described later is ignored).

Figure 9:
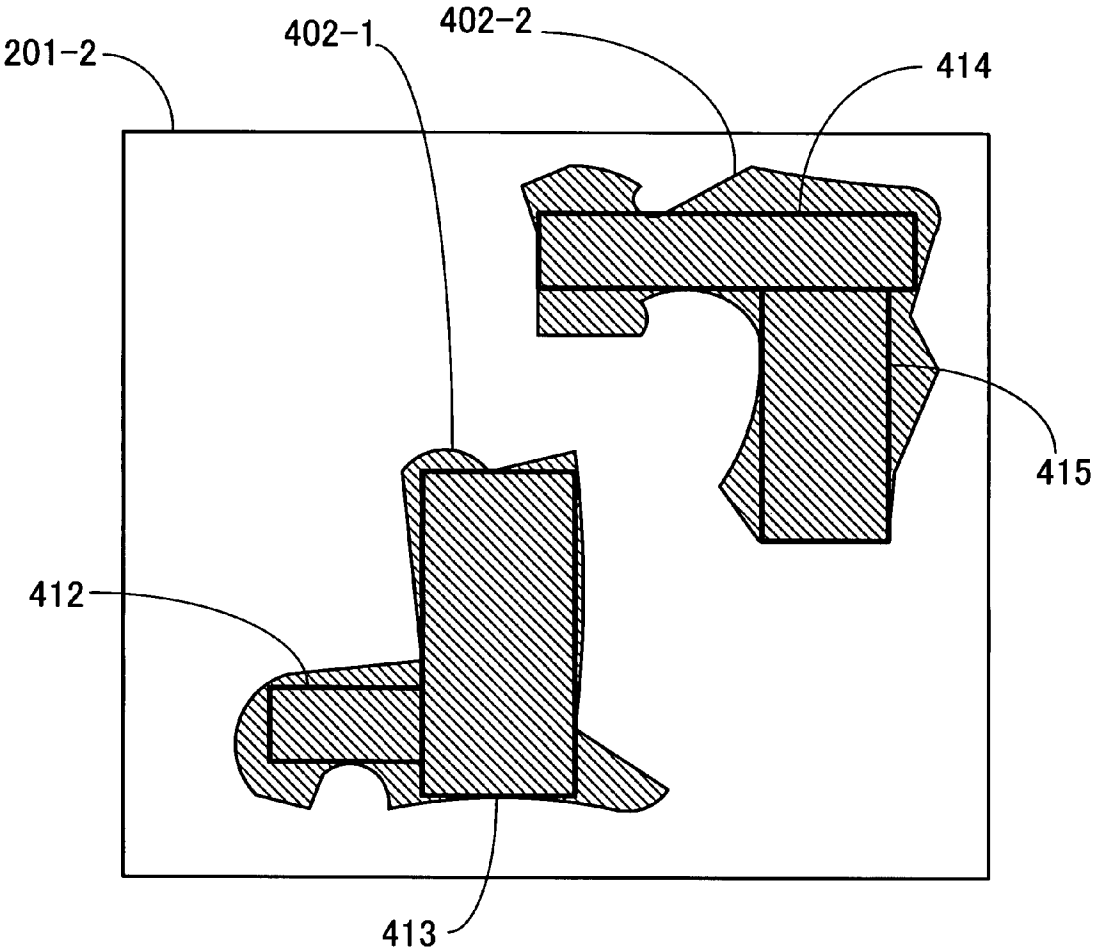
FIG. 9 is a schematic view showing a superposition of the image data stored in the second-layer frame buffer and mask areas.
Figure 10:
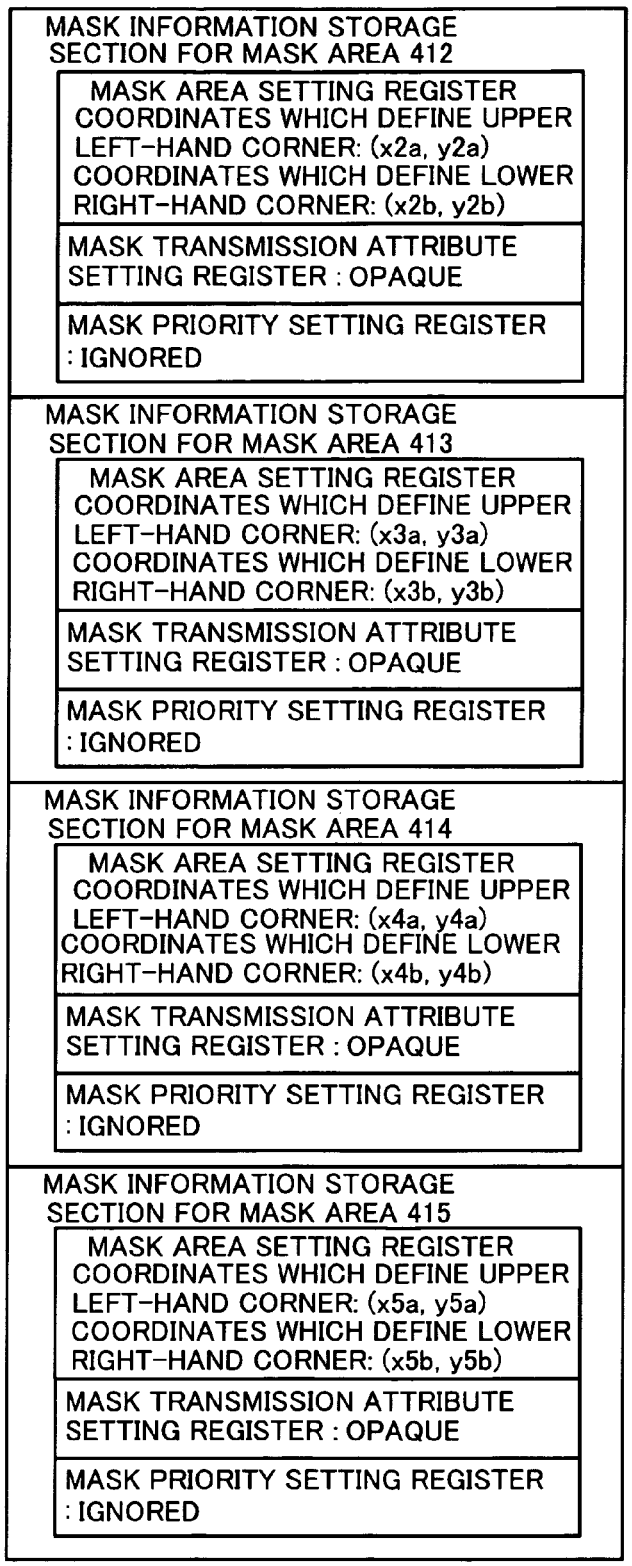
FIG. 10 shows mask information stored in a second-layer mask information storage section.

FIG. 9 is a schematic view showing a superposition of the image data stored in the second-layer frame buffer and mask areas. FIG. 10 shows mask information stored in a second-layer mask information storage section.

Mask areas 412, 413, 414, and 414 are set to the figures 402-1 and 402-2 stored in the second-layer frame buffer 201-2. In this example, the figures 402-1 and 402-2 are opaque, so the transmission attributes of the mask areas 412, 413, 414, and 415 are set to "opaque". As shown in FIG. 10, these pieces of mask information are stored in individual mask information storage sections in the second-layer mask control section 110-2.

The graphics LSI 100 according to the embodiment of the present invention performs the following process on the basis of the above mask information.

Figure 11:
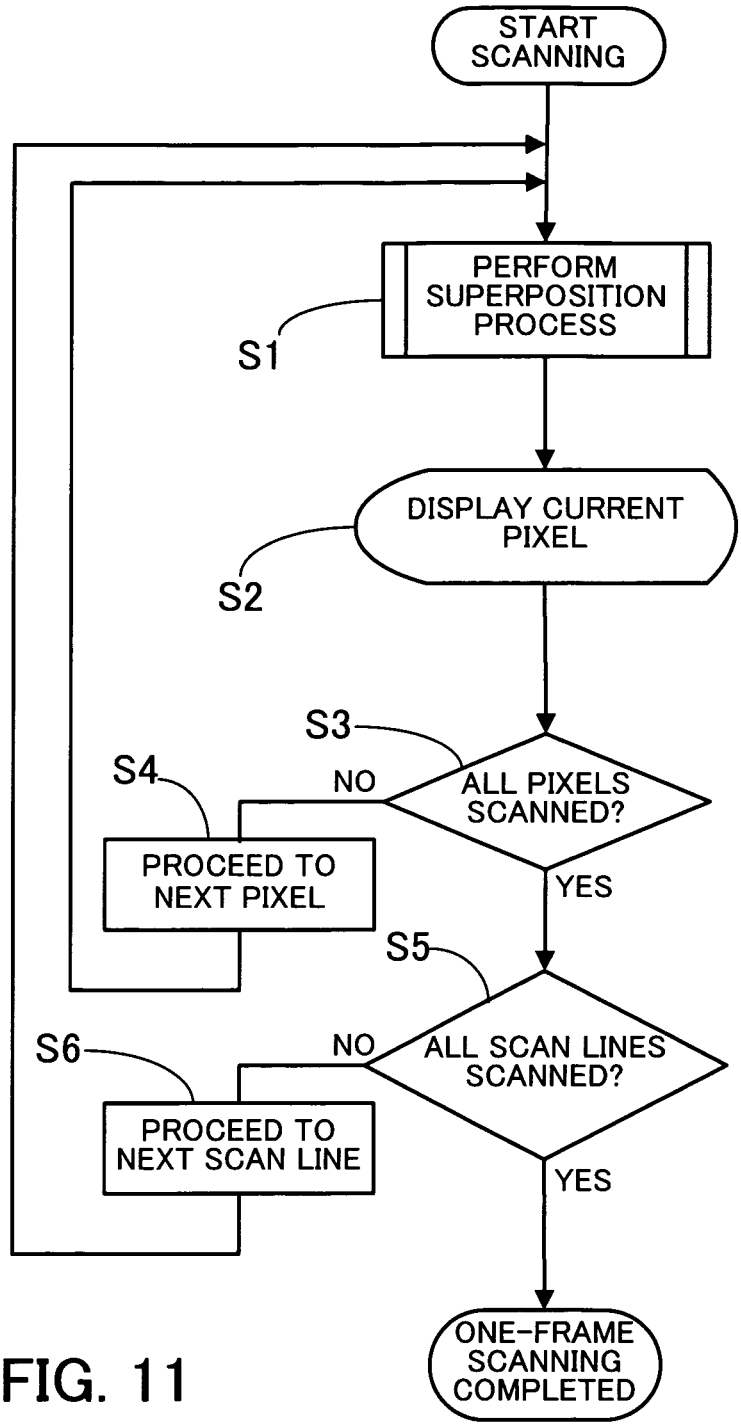
FIG. 11 is a flow chart showing the whole of a process performed by a graphics LSI.

FIG. 11 is a flow chart showing the whole of a process performed by the graphics LSI.

In FIG. 11, the process from the beginning of scanning to the completion of one-frame scanning is shown.

When scanning is begun, a layer superposition process is performed (step S1). Data obtained as a result of the superposition process is displayed on the display unit 300 as a current pixel (step S2). Whether or not steps S1 and S2 have been performed on all pixels (included not in the entire screen but in one scan line) is then determined (step S3). If steps S1 and S2 have not been performed yet on all the pixels, then the graphics LSI 100 proceeds to the next pixel (step S4) and the process is repeated from step S1. When all the pixels have been scanned, whether or not all scan lines have been scanned is determined (step S5). If all the scan lines have not been scanned yet, then the graphics LSI 100 proceeds to the next scan line (step S6) and the process is repeated from step S1. When all the scan lines have been scanned, one-frame scanning is completed.

Figure 12:
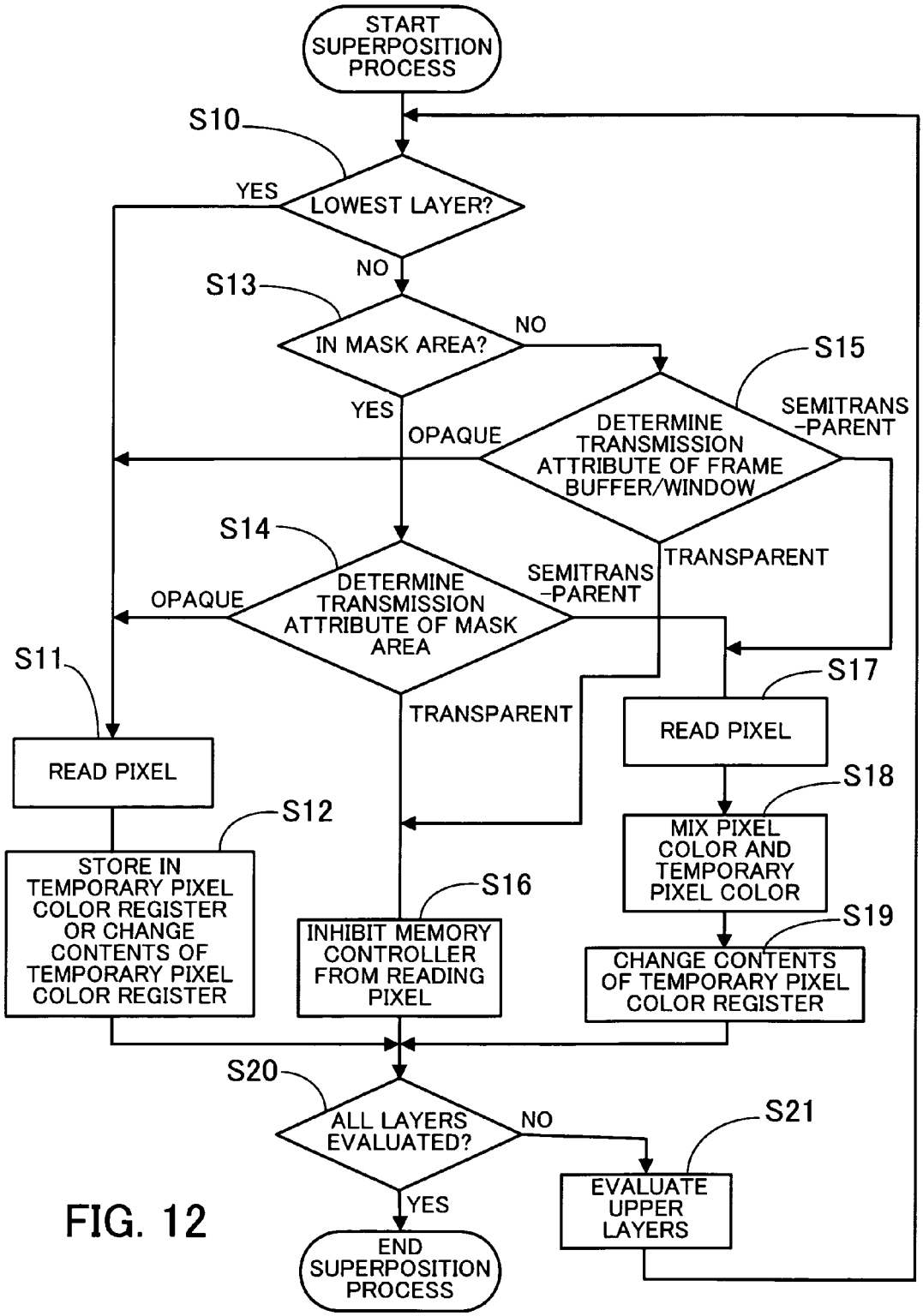
FIG. 12 is a flow chart showing the details of a superposition process.

FIG. 12 is a flow chart showing the details of a superposition process.

The case where a superposition process begins with the lowest layer will be described.

First, the superposition order holding section 124*a* is referred to and whether or not a pixel which is being scanned is stored in the lowest-layer frame buffer 201-3 is determined (step S10). A pixel at the lowest layer is evaluated first. Accordingly, the color mixing process section 124*b* makes the memory controller 123 read the pixel which is being scanned from the frame buffer 201-3 (step S11), stores a pixel color of this pixel in the temporary pixel color register 121, and proceeds to step S20 (step S12). When the evaluation of image data at the lowest layer is completed, whether or not all layers have been evaluated is determined (step S20). In this case, all the layers have not been evaluated yet ("NO" in step S20). Accordingly, the upper layers are evaluated (step S21). A mask area inside/outside determination section in the second-layer mask control section 110-2 refers to the mask area setting registers and determines whether a pixel at the second layer which is being scanned is in the mask area 412, 413, 414, or 415 (step S13). If the pixel at the second layer which is being scanned is in the mask area 412, 413, 414, or 415 shown in FIG. 9, then a mask transmission attribute determination section 114 refers to one of the mask information storage sections shown in FIG. 10, and determines the transmission attribute of the mask area 412, 413, 414, or 415 in which the pixel exists (step S14). If the pixel is outside the mask areas 412, 413, 414, and 415, then the mask transmission attribute determination section 114 refers to a frame buffer/window information storage section in the second-layer mask control section 110-2 and determines the transmission attribute of the second-layer frame buffer 201-2 in which the pixel is stored (step S15). A temporary transmission attribute, being the result of the determination, is stored in a temporary transmission attribute register in the second-layer mask control section 110-2. If the transmission attribute is opaque, then the color mixing process section 124*b* makes the memory controller 123 read the pixel which is being scanned (step S11). This is the same with the lowest layer. The color mixing process section 124*b* changes the contents of the temporary pixel color register 121 to the pixel color of this pixel (step S12). If the transmission attribute is transparent, then the color mixing process section 124*b* inhibits the memory controller 123 from reading the pixel and does not change the contents of the temporary pixel color register 121. Step S20 is then performed (step S16). If the transmission attribute is semitransparent, then the color mixing process section 124*b* makes the memory controller 123 read the pixel which is being scanned (step S17), mixes the pixel color of this pixel and the pixel color (stated as a "temporary pixel color" in FIG. 12) stored in the temporary pixel color register 121 (step S18), and changes the contents of the temporary pixel color register 121 to a pixel color obtained (step S19). The above process is also performed on the highest layer to determine a final pixel color.

Figure 13:
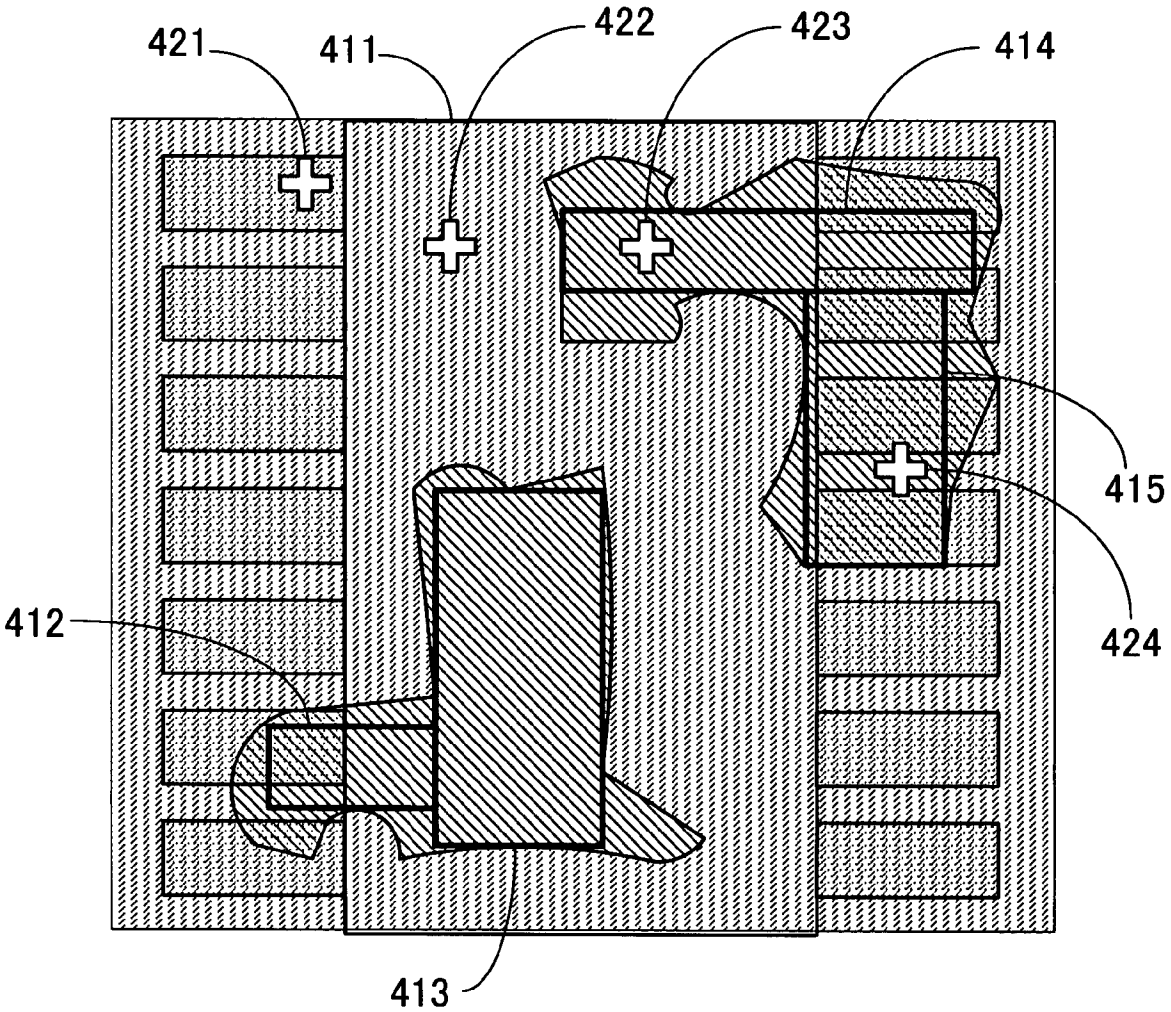
FIG. 13 is a view for describing a concrete example of a mask area inside/outside determination process and a transmission attribute determination process performed on a pixel.

FIG. 13 is a view for describing a concrete example of a mask area inside/outside determination process and a transmission attribute determination process performed on a pixel. FIG. 14 shows the result of determination made by a mask control section.

In this example, whether pixel coordinates 421, 422, 423, or 424 which are being scanned at a moment are in or outside a mask area is determined. The pixel coordinates 421 and 424 are outside the mask area 411 at the first layer, so the transmission attribute of the frame buffer 201-1 ("semitransparent" for the pixel coordinates 421 which are on the button, and "transparent" for the pixel coordinates 424) is stored in the temporary transmission attribute register 116 in the first-layer mask control section 110-1. The pixel coordinates 422 and 423 are in the mask area 411, so the transmission attribute (transparent) of the mask area 411 is stored in the temporary transmission attribute register 116 as a temporary transmission attribute. The pixel coordinates 421 and 422 are outside the mask areas at the second layer, so the transmission attribute (transparent) of the frame buffer 201-2 is stored in a temporary transmission attribute register in the second-layer mask control section 110-2. The pixel coordinates 423 are in the mask area 414 and the pixel coordinates 424 are in the mask area 415. Accordingly, the transmission attributes (opaque) of the mask areas 414 and 415 are stored.

If the transmission attribute of image data which is being scanned is transparent, then performing the superposition process shown in FIG. 12 in this way saves the memory controller 123 reading the image data.

In the above descriptions, mask areas set at one layer do not overlap. However, a plurality of mask areas may overlap. In this case, the mask priority determination section 113 included in the graphics LSI 100 shown in FIG. 2 is used.

A process performed by the graphics LSI 100 in the case of mask areas overlapping will now be described.

The process for displaying the above image which is shown in FIG. 6 and which is obtained by superimposing the image data shown in FIG. 3 and stored in the first-layer frame buffer 201-1 secured in the VRAM 200, the image data shown in FIG. 4 and stored in the second-layer frame buffer 201-2 secured in the VRAM 200, and the image data shown in FIG. 5 and stored in the third-layer frame buffer 201-3 secured in the VRAM 200 will be described.

Figure 15:
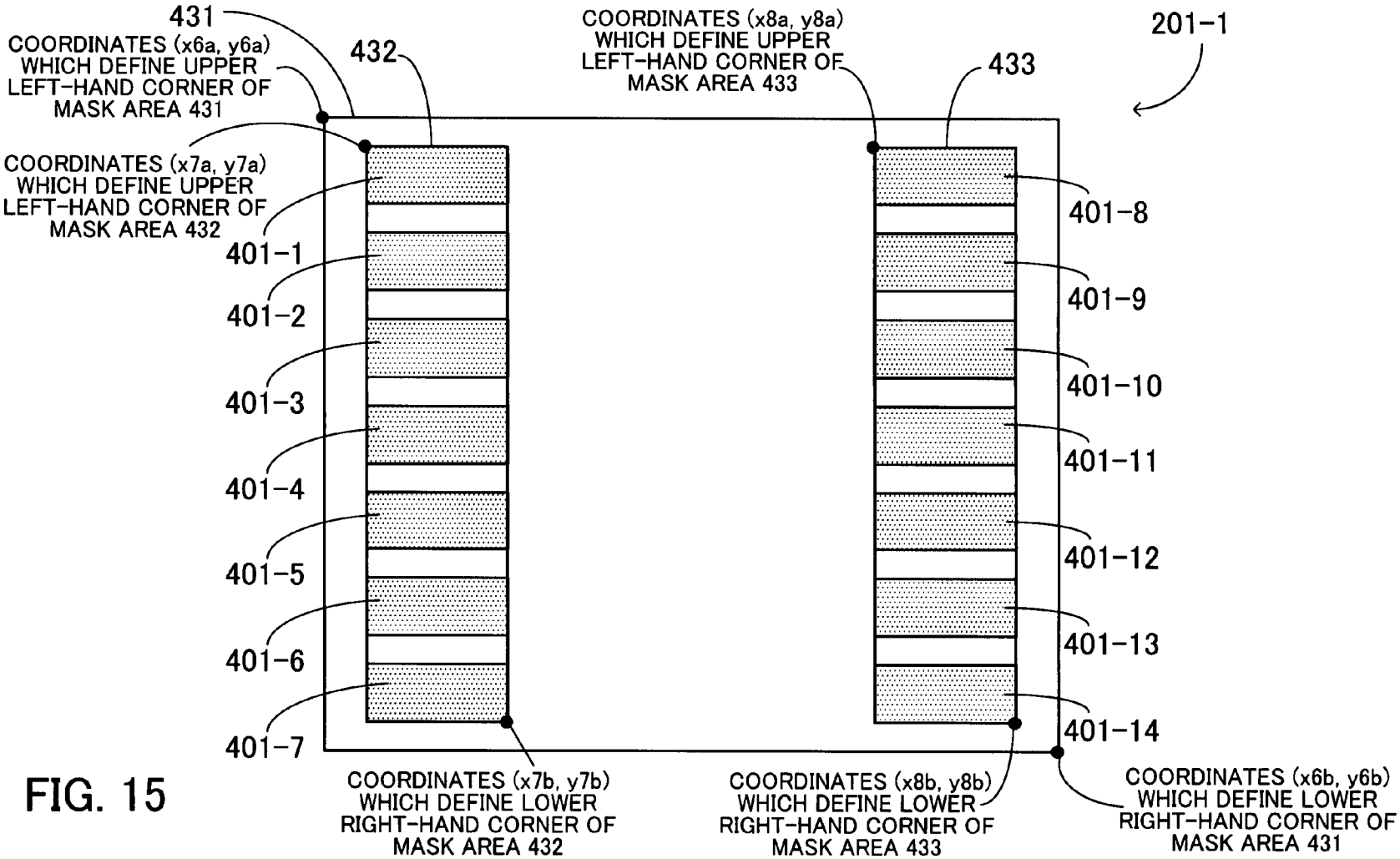
FIG. 15 is a schematic view showing a superposition of the image data stored in the first-layer frame buffer and mask areas two of which lap over the other.
Figure 16:
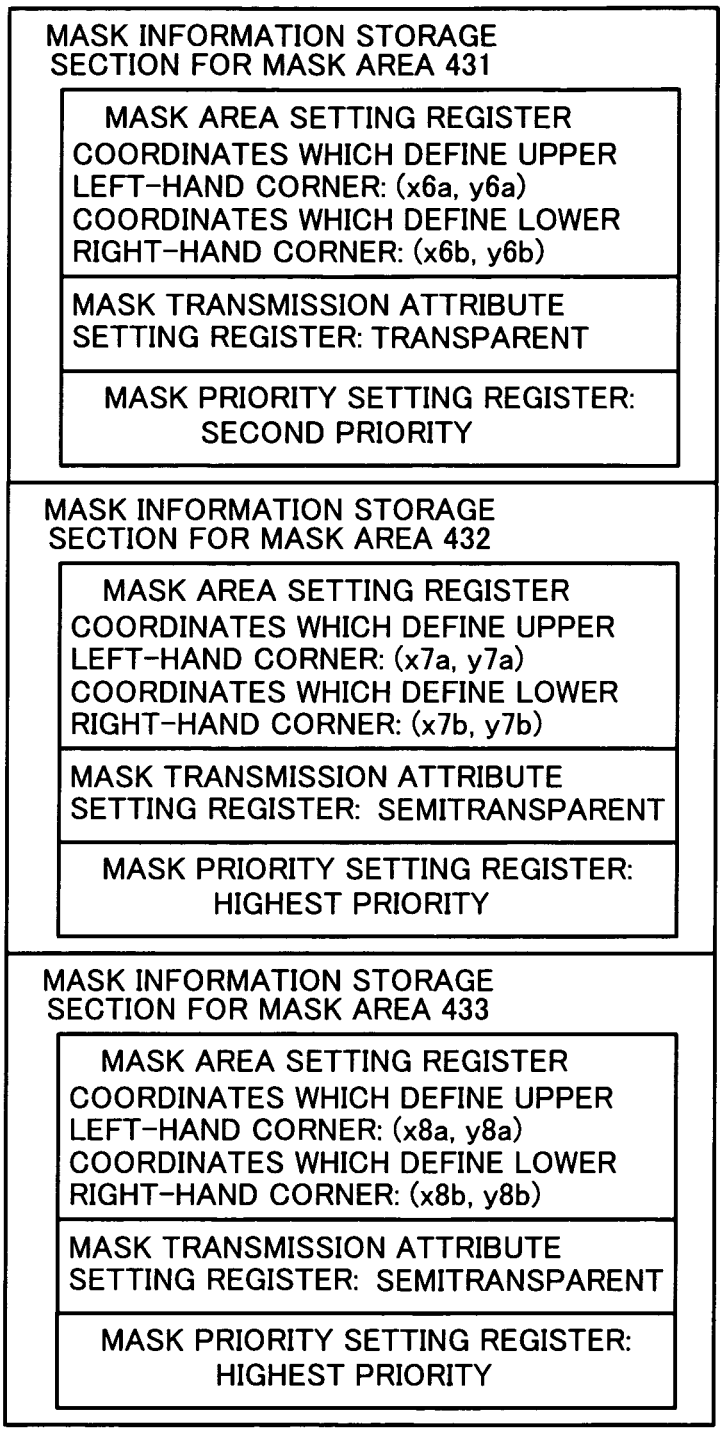
FIG. 16 shows mask information stored in the first-layer mask information storage section.

FIG. 15 is a schematic view showing a superposition of the image data stored in the first-layer frame buffer and mask areas two of which lap over the other. FIG. 16 shows mask information stored in the first-layer mask information storage section.

A mask area 431 which covers the whole of the frame buffer 201-1, a mask area 432 which covers the buttons 401-1 through 401-7, and a mask area 433 which covers the buttons 401-8 through 401-14 are set at the first layer. The transmission attributes of the mask areas 431, 432, and 433 are transparent, semitransparent, and semitransparent respectively. In this example, the mask areas 432 and 433 lap over the mask area 431. In such a case, priority is established to determine which of the transmission attributes of two mask areas should be adopted for a pixel which is being scanned. In this example, it is assumed that the priority of the mask area 431 is second and that the priority of the mask areas 432 and 433 is the highest.

As shown in FIG. 16, such mask information is stored in advance in mask information storage sections. That is to say, coordinates which define the upper left-hand corners and the lower right-hand corners of the mask areas 431, 432, and 433 are stored in mask area setting registers. The transmission attributes of the mask areas 431, 432, and 433 are stored in mask transmission attribute setting registers. The priority of the mask areas 431, 432, and 433 are stored in mask priority setting registers.

Figure 17:
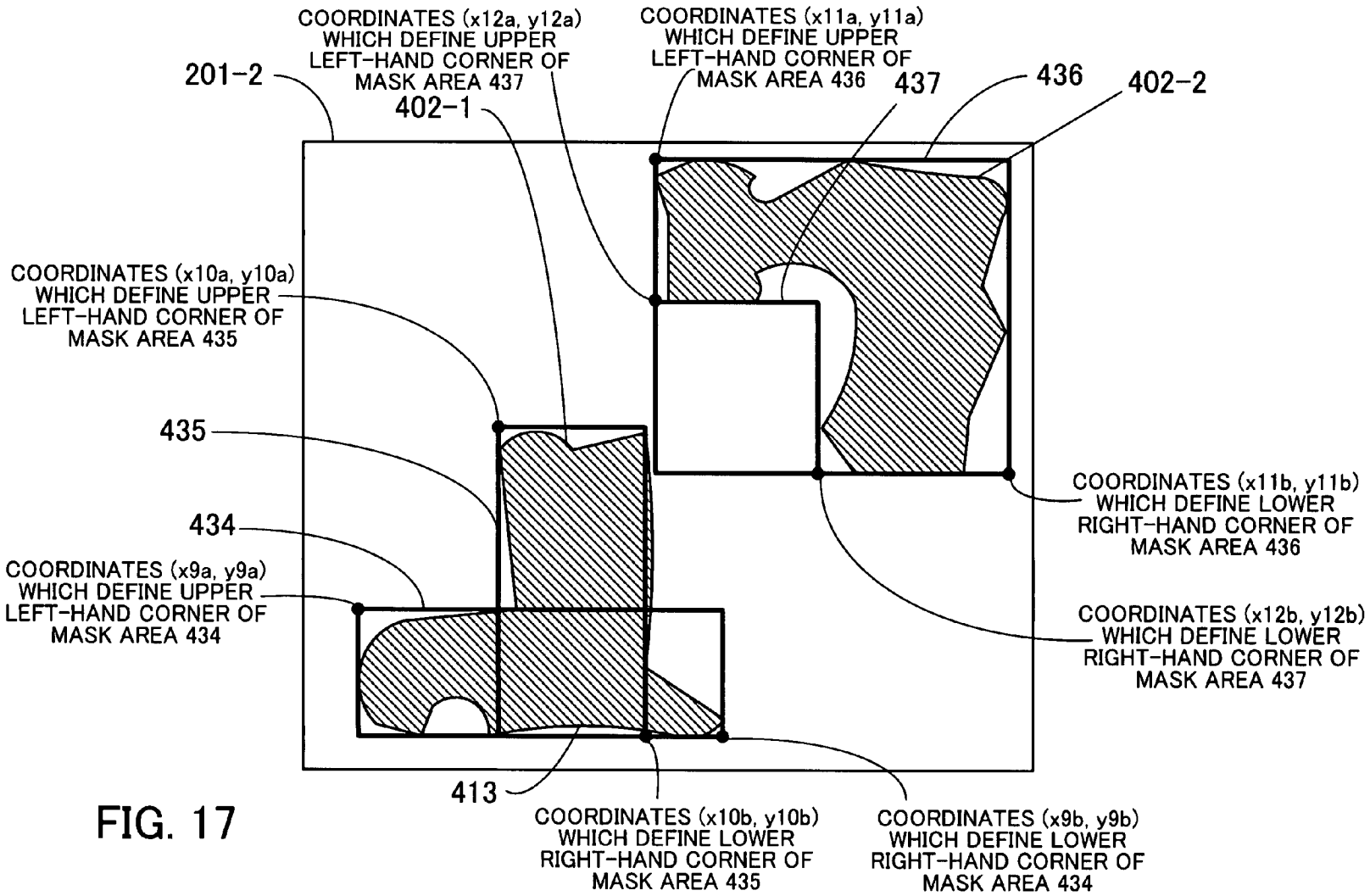
FIG. 17 is a schematic view showing a superposition of the image data stored in the second-layer frame buffer and mask areas one of which laps over the other or which overlap.

FIG. 17 is a schematic view showing a superposition of the image data stored in the second-layer frame buffer and mask areas one of which laps over the other or which overlap. FIG. 18 shows mask information stored in the second-layer mask information storage section.

Mask areas 434 and 435 which cover the figure 402-1 and which overlap, a mask area 436 which covers the figure 402-2, and a mask area 437 which laps over a portion of the mask area 436 which does not include the figure 402-2 are set at the second layer. The transmission attributes of the mask areas 434, 435, and 436 are opaque and the transmission attribute of the mask area 437 is transparent. The mask areas 434 and 435 are both opaque. Therefore, either of the transmission attributes of the mask areas 434 and 435 can be referred to when a pixel is being scanned. In this example, it is assumed that the priority of the mask areas 434 and 435 is the highest. There is no need to read a pixel in the mask area 437. Accordingly, it is assumed that the priority of the mask area 436 is second and that the priority of the mask area 437 is the highest. As shown in FIG. 18, such mask information is stored in individual mask information storage sections in the second-layer mask control section 110-2.

The graphics LSI 100 according to the embodiment of the present invention performs the following superposition process on the basis of the above mask information. The entire process is performed in a manner identical to the process shown in FIG. 11.

Figure 19:
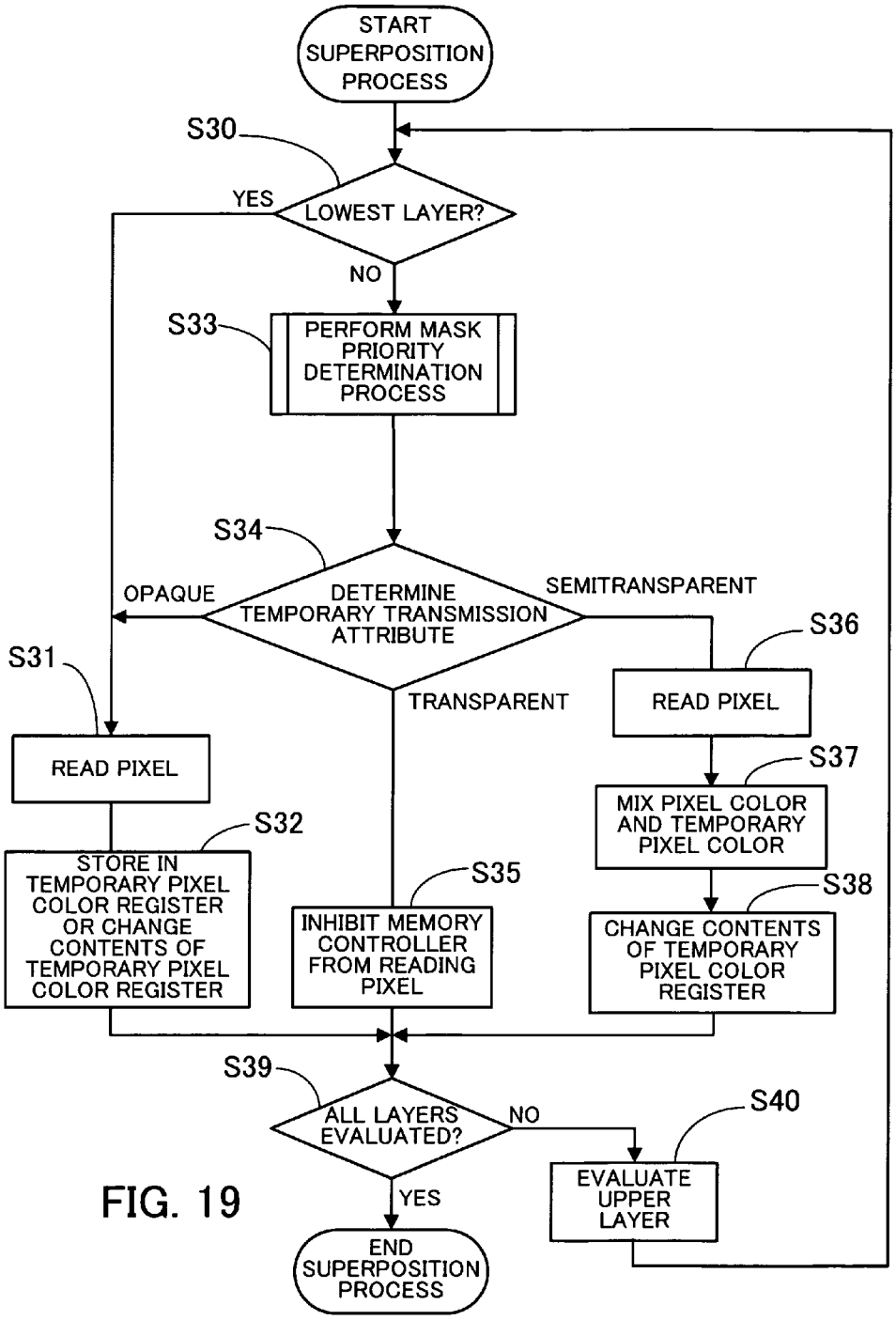
FIG. 19 is a flow chart showing the details of a superposition process performed in the case of a plurality of mask areas overlapping.

FIG. 19 is a flow chart showing the details of a superposition process performed in the case of a plurality of mask areas overlapping.

First, the superposition order holding section 124*a* is referred to and whether or not image data which is being scanned is stored in the lowest-layer frame buffer 201-3 is determined (step S30). Image data at the lowest layer is evaluated first. Accordingly, the color mixing process section 124*b* makes the memory controller 123 read the image data which is being scanned from the frame buffer 201-3 (step S31), stores the image data in the temporary pixel color register 121, and proceeds to step S39 (step S32). When the evaluation of image data at the lowest layer is completed, whether or not all layers have been evaluated is determined (step S39). In this case, all the layers have not been evaluated yet ("NO" in step S39). Accordingly, the upper layers are evaluated (step S40). A mask priority determination section in the second-layer mask control section 110-2 performs a mask priority determination process at the second layer (step S33). After the mask priority determination section performs the mask priority determination process, the color mixing process section 124*b* refers to a temporary transmission attribute register in which a temporary transmission attribute is stored, and determines the temporary transmission attribute (step S34). If the transmission attribute is opaque, then the color mixing process section 124*b* makes the memory controller 123 read a pixel which is being scanned (step S31). This is the same with the lowest layer. The color mixing process section 124*b* changes the contents of a temporary pixel color register 121 to the pixel color of this pixel (step S32). If the transmission attribute is transparent, then the color mixing process section 124*b* inhibits the memory controller 123 from reading the pixel and does not change the contents of the temporary pixel color register 121. Step S39 is then performed (step S35). If the transmission attribute is semitransparent, then the color mixing process section 124*b* makes the memory controller 123 read the pixel which is being scanned (step S36), mixes the pixel color of this pixel and the pixel color (stated as a "temporary pixel color" in FIG. 19) stored in the temporary pixel color register 121 (step S37), and changes the contents of the temporary pixel color register 121 to data obtained (step S38). The above process is also performed on the highest layer to determine a final pixel color.

Figure 20:
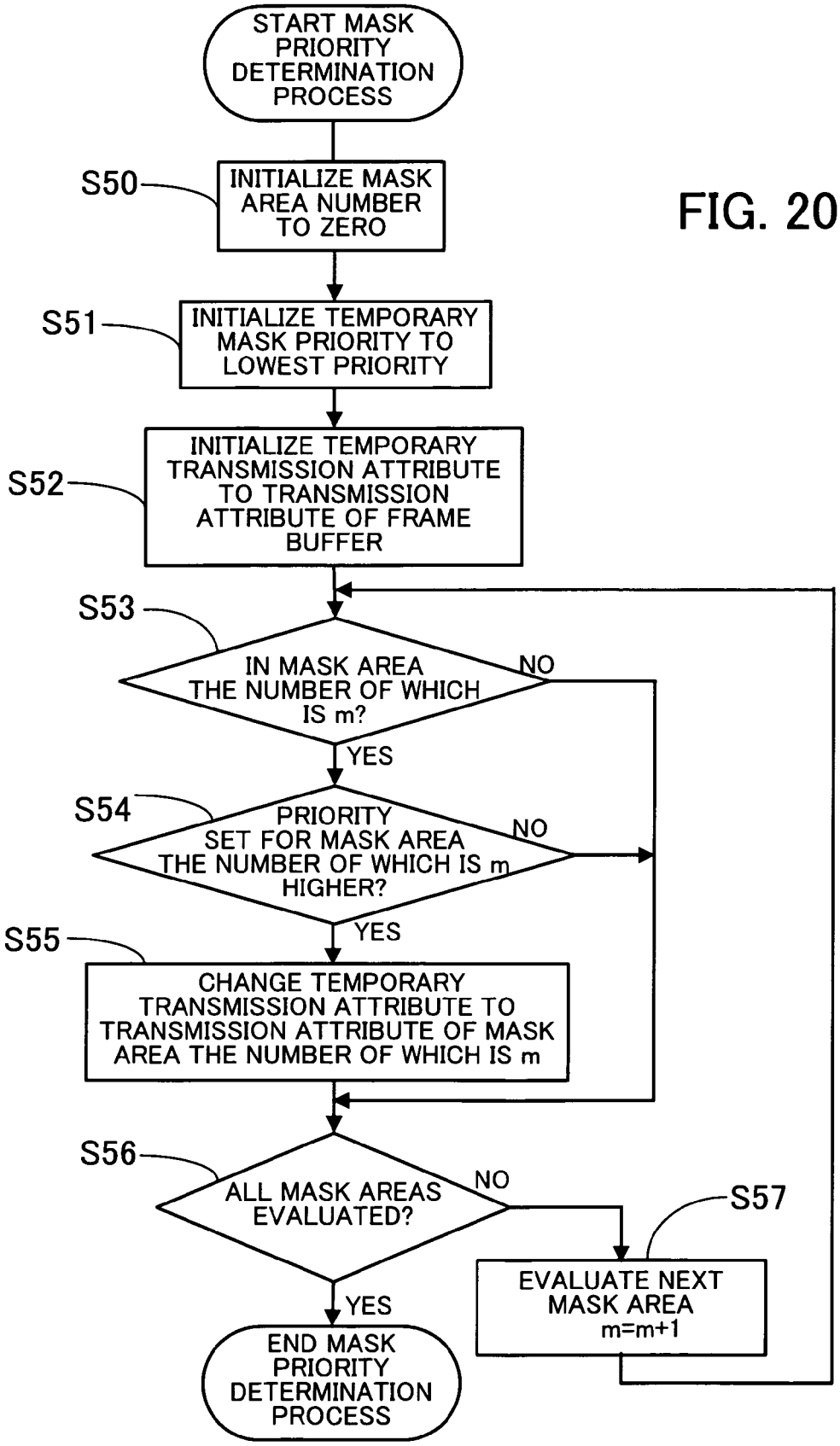
FIG. 20 is a flow chart showing the details of a mask priority determination process.

FIG. 20 is a flow chart showing the details of a mask priority determination process.

It is assumed that a plurality of (m) mask areas are set at the same layer and that a mask area number is m. In a mask priority determination process, m is initialized to zero (step S50). Mask priority temporarily stored (hereinafter referred to as the "temporary mask priority") is initialized to the lowest priority (step S51). A temporary transmission attribute is initialized to the transmission attribute of a frame buffer at the current layer (step S52). The order of steps S50, S51, and S52 may be changed or steps S50, S51, and S52 may be performed in parallel.

Whether or not current pixel coordinates are in a mask area the number of which is m is then determined (step S53). If the current pixel coordinates are outside the mask area the number of which is m, then step S56 is performed. If the current pixel coordinates are in the mask area the number of which is m, then the temporary mask priority currently stored is compared with priority set for the mask area the number of which is m (step S54). If the priority set for the mask area the number of which is m is higher than the temporary mask priority currently stored, then the temporary mask priority is changed to the priority set for the mask area the number of which is m, and the temporary transmission attribute is changed to the transmission attribute of the mask area the number of which is m (step S55). Whether or not all mask areas included in the current layer have been evaluated is then determined (step S56). If all the mask areas included in the current layer have been evaluated, then the mask priority determination process terminates. If all the mask areas included in the current layer have not been evaluated, then m is incremented (m=m+1) and the next mask area is evaluated (step S57).

By performing the above mask priority determination process, the transmission attribute of a mask area the priority of which is the highest at the current pixel coordinates is stored in a temporary transmission attribute register at some layer. If the current pixel coordinates are not in any of mask areas, then the transmission attribute of the frame buffer stored in a temporary transmission attribute register at the initialization time remains. The temporary transmission attribute settled in this way is used in the temporary transmission attribute determination step (step S34) shown in FIG. 19.

Figure 21:
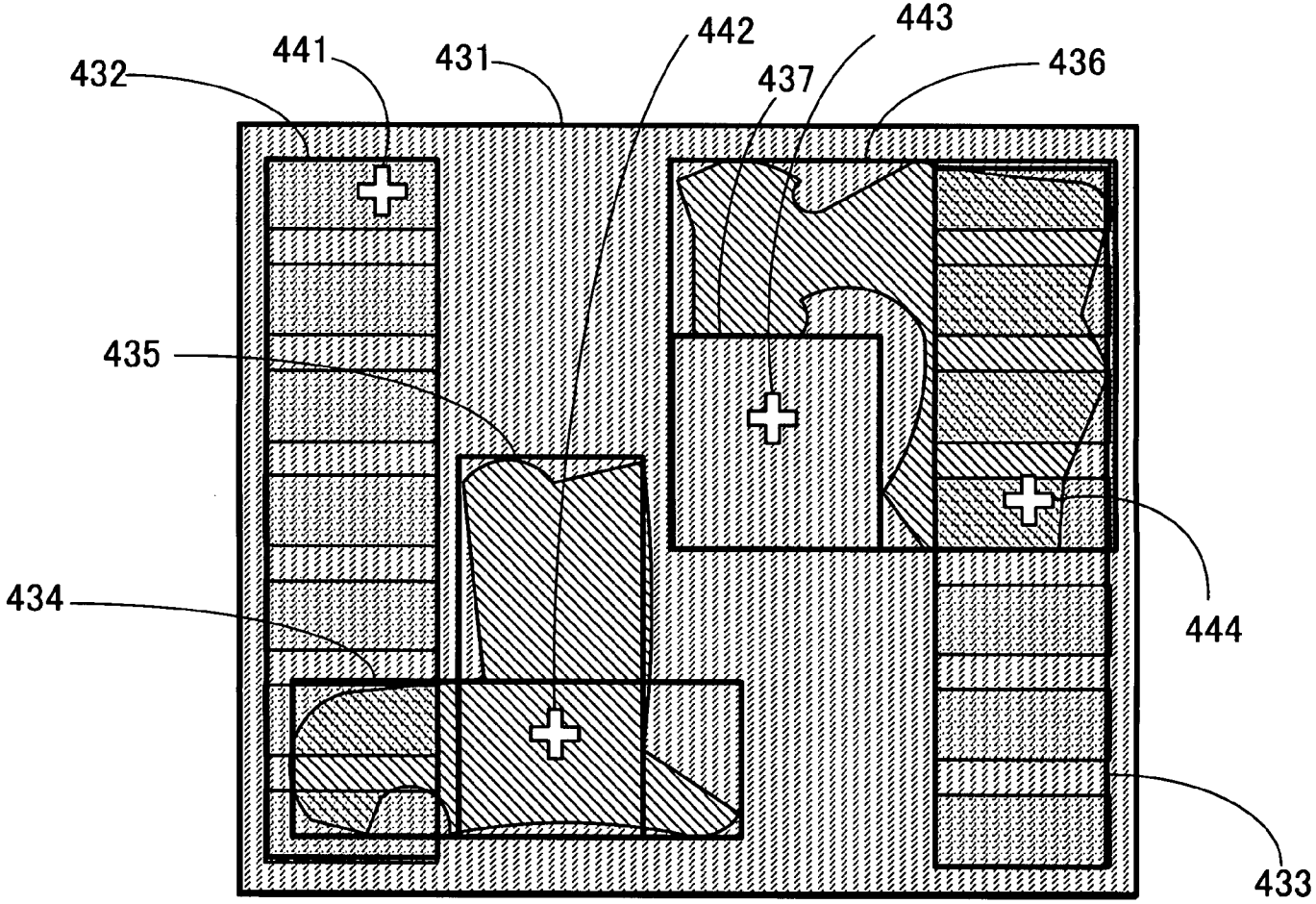
FIG. 21 is a view for describing a concrete example of a mask area inside/outside determination process and a priority determination process performed at a pixel and a concrete example of the result of transmission attribute determination made at the pixel.

FIG. 21 is a view for describing a concrete example of a mask area inside/outside determination process and a priority determination process performed at a pixel and a concrete example of the result of transmission attribute determination made at the pixel. FIG. 22 shows the result of determination made by the mask control section.

In this example, a mask area inside/outside determination section determines whether pixel coordinates 441, 442, 443, or 444 which are being scanned at a moment are in or outside a mask area, and a mask priority determination section determines the priority of the mask area and a temporary transmission attribute.

At the first layer, the pixel coordinates 441 are in the mask areas 431 and 432. By performing the process shown in FIG. 20, the mask priority determination section stores the transmission attribute "semitransparent" of the mask area 432 adopted in a temporary transmission attribute register as a temporary transmission attribute. The pixel coordinates 442 and 443 are in the mask area 431. In this case, the transmission attribute "transparent" of the mask area 431 is a temporary transmission attribute. The pixel coordinates 444 are in the mask areas 431 and 433. By performing the process shown in FIG. 20, the mask priority determination section treats the transmission attribute "semitransparent" of the mask area 433 adopted as a temporary transmission attribute.

At the second layer, the pixel coordinates 441 are outside the mask areas. Accordingly, the transmission attribute "transparent" of the frame buffer 201-2 at the second layer is treated as a temporary transmission attribute. The pixel coordinates 442 are in the mask areas 434 and 435. The priority of the mask area 434 is equal to that of the mask area 435, so the mask priority determination section performs the process shown in FIG. 20 to adopt the mask area 434 the number of which is smaller than that of the mask area 435 and to treat the transmission attribute "opaque" of the mask area 434 as a temporary transmission attribute. The pixel coordinates 443 are in the mask areas 436 and 437. The mask priority determination section performs the process shown in FIG. 20 to adopt the mask area 437 the priority of which is higher than that of the mask area 436 and to treat the transmission attribute "transparent" of the mask area 437 as a temporary transmission attribute. The pixel coordinates 444 are in the mask area 436, so the transmission attribute "opaque" of the mask area 436 is treated as a temporary transmission attribute.

As a result, mask areas having different transmission attributes may overlap and a more flexible arrangement of mask areas can be defined. Therefore, a figure having a complicated shape can be surrounded efficiently by mask areas and useless memory access to the VRAM 200 can be reduced further.

To explain the overlapping of mask areas having different transmission attributes, the whole of the frame buffer 201-1 at the first layer is surrounded by the mask area 431 in FIG. 15. However, even if the mask area 431 is not used, the same result can be obtained by making the transmission attribute of the frame buffer 201-1 at the first layer transparent. The priority of the mask areas 434 and 435 shown in FIG. 17 is the highest. However, the transmission attributes of the mask areas 434 and 435 are opaque. Therefore, if the priority of the mask areas 434 and 435 is higher than that of the mask area 431, then the priority of the mask area 434 may differ from that of the mask area 435. It does not matter whether the priority of the mask area 434 is higher or lower than that of the mask area 435. In FIG. 17, the mask areas 434, 435, and 436 are arranged so that they will surround the opaque figures 402-1 and 402-2 at the second layer from the outside. In this case, even if the transmission attributes of the mask areas are opaque, clearances between the mask area 434 and the figure 402-1, between the mask area 435 and the figure 402-1, and between the mask area 436 and the figure 402-2 must be treated properly. That is to say, these clearances must be considered transparent. However, this can be realized by a known technique commonly used, and descriptions of the technique will be omitted.

The superposition process shown in FIG. 12 or 19 is performed from the lowest layer. Accordingly, even if an area the transmission attribute of which is opaque is included in some layer, the reading of image data at a layer under that layer cannot be inhibited. A process for inhibiting such reading will be described.

The function of the effective lowest layer detection section 120 included in the graphics LSI 100 shown in FIG. 2 is used for performing this process.

A superposition process performed by using the effective lowest layer detection section 120 will now be described. The entire process is the same as the process shown in FIG. 11.

The case where the above mask areas are not used will be described first.

Figure 23:
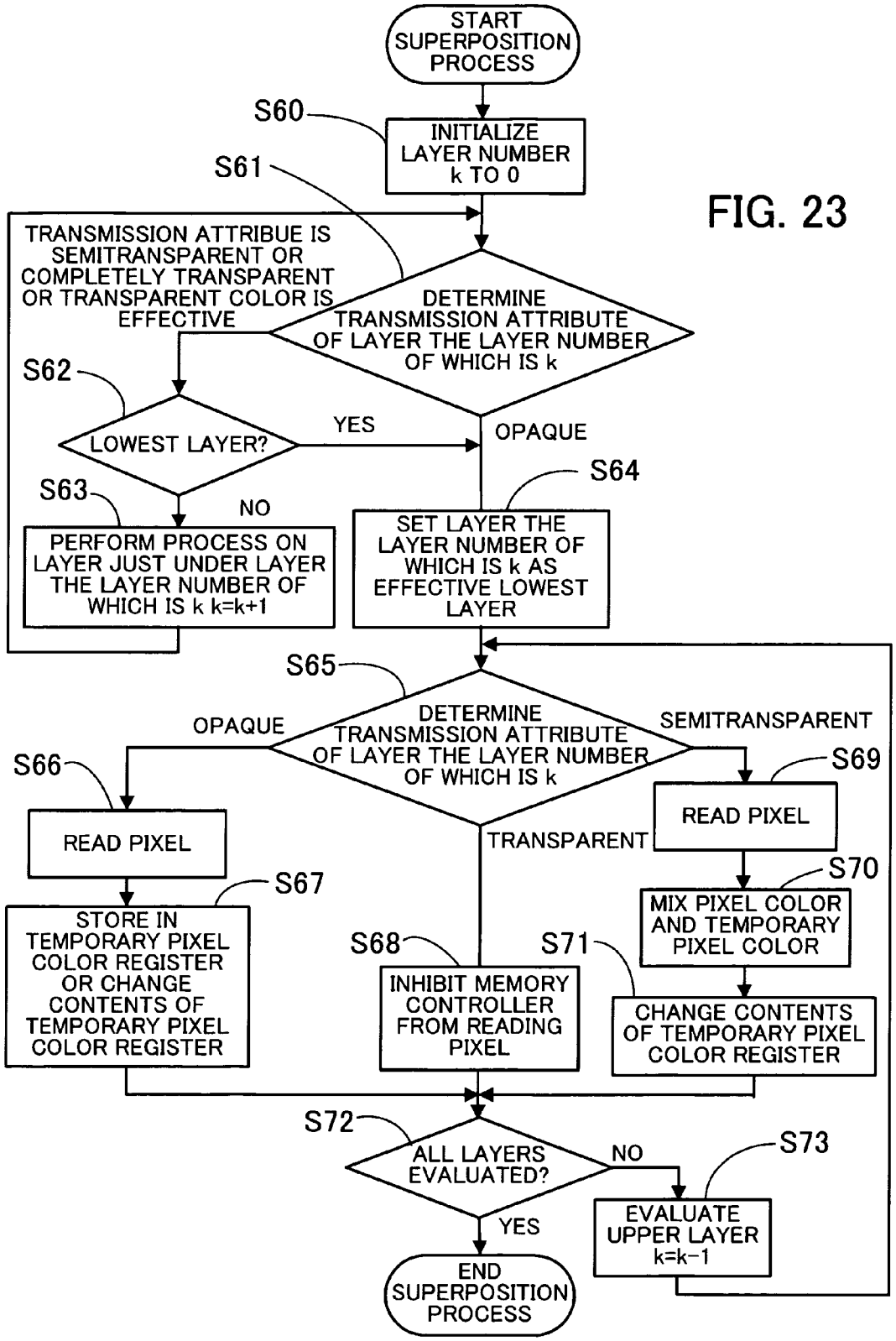
FIG. 23 is a flow chart showing the details of a superposition process performed by using the function of detecting an effective lowest layer.

FIG. 23 is a flow chart showing the details of a superposition process performed by using the function of detecting an effective lowest layer.

Layer numbers k are given in order to the frame buffers 201-1 through 201-3 secured in the VRAM 200 from the highest layer. The layer number k of the frame buffer 201-1 at the highest layer is 0. This order of superposition is held by the superposition order holding section 124*a*.

When the superposition process is begun, the layer number k is initialized to 0 so that the frame buffer 201-1 at the highest layer can be referred to (step S60). The transmission attribute at a pixel being scanned of a layer (frame buffer or window) the layer number of which is k is then determined (step S61). If the transmission attribute of the layer the layer number of which is k is semitransparent or transparent or a transparent color is effective at the layer the layer number of which is k, then whether or not the layer the layer number of which is k is the lowest layer is determined (step S62). If the layer the layer number of which is k is not the lowest layer, then the layer number k is incremented (k=k+1) and the process from step S61 is performed on a layer just under the layer the layer number of which is k (step S63). If the transmission attribute of the layer the layer number of which is k is opaque or the layer the layer number of which is k is the lowest layer, then the layer the layer number of which is k is set as an effective lowest layer (step S64). A transparent color is commonly used. It is assumed that a transparent color is effectively set at a layer. If the color of some pixel stored in a frame buffer at the layer matches the transparent color, this pixel is considered to be transparent and the color of a pixel at a lower layer is displayed.

After the layer the layer number of which is k is established as an effective lowest layer, the superposition process is performed in a way which depends on the transmission attribute of the layer the layer number of which is k. Steps S66 through S72 shown in FIG. 23 are the same as the process shown in, for example, FIG. 19, so descriptions of them will be omitted. In the case of FIG. 23, however, the effective lowest layer set by steps S60 through S64 is adopted as a first layer used for the superposition process instead of the actual lowest layer. That is to say, in step S73, the layer number k is decremented (k=k−1) and the process is performed on a layer just over the effective lowest layer the layer number of which is k.

If the effective lowest layer is higher than the actual lowest layer, the above process obviates the necessity of reading image data stored in a frame buffer at a layer lower than the effective lowest layer and useless memory access to the VRAM 200 can be suppressed.

If arrangement and size on a screen at each layer are the same, there is no need to perform an effective lowest layer detection process according to pixels. That is to say, there is no need to perform an effective lowest layer detection process in the pixel scanning process which is shown in FIG. 11 and which is the whole of the process performed by the graphics LSI 100. However, arrangement and size on a screen at each layer may not be the same. If a screen is partially displayed in a window and there are areas where two layers do not overlap, an effective lowest layer may differ according to pixel coordinates. In such a case, an effective lowest layer is detected according to pixels scanned.

A process performed by using an effective lowest layer and mask areas will now be described.

Figure 24:
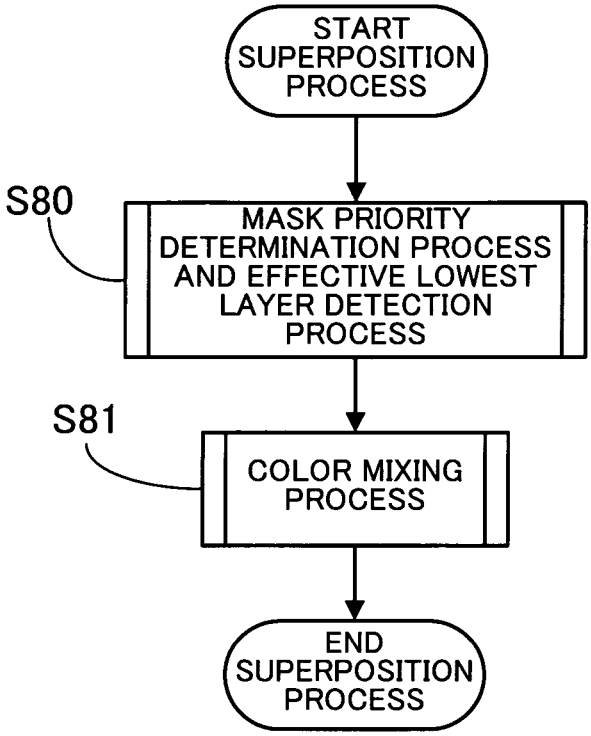
FIG. 24 is a flow chart showing a superposition process performed by using an effective lowest layer and mask areas.

FIG. 24 is a flow chart showing a superposition process performed by using an effective lowest layer and mask areas.

As shown in FIG. 24, this process includes a mask priority determination process and an effective lowest layer detection process (step S80) and a color mixing process (step S81).

Figure 25:
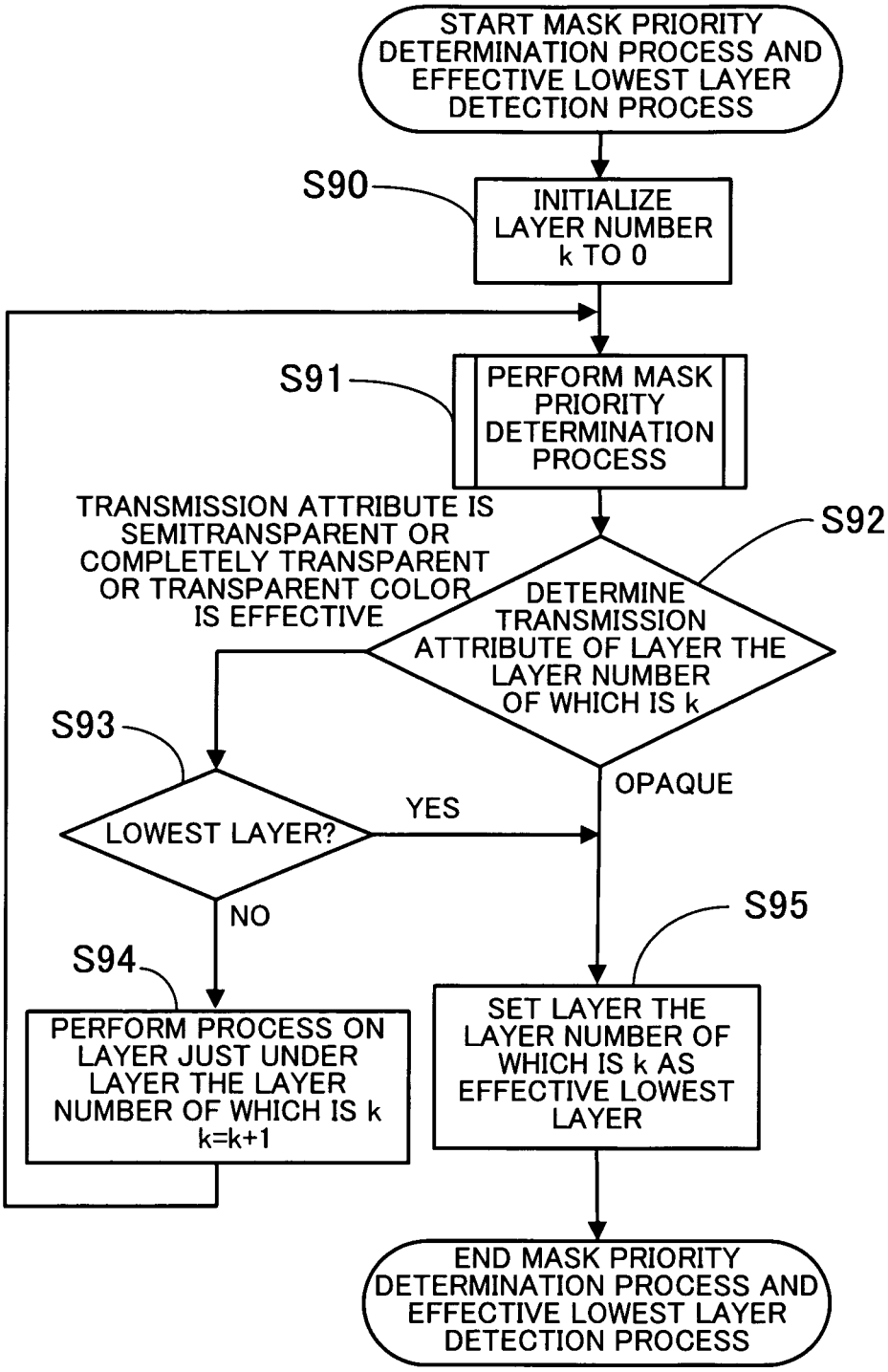
FIG. 25 is a flow chart showing the details of a mask priority determination process and an effective lowest layer detection process.

FIG. 25 is a flow chart showing the details of the mask priority determination process and the effective lowest layer detection process.

When the process is begun, the layer number k is initialized first to 0 so that the frame buffer 201-1 at the highest layer can be referred to (step S90). The mask priority determination process shown in FIG. 20 is then performed at a layer the layer number of which is k to determine a temporary transmission attribute at a pixel which is being scanned (step S91). A process that is the same as steps S61 through S64 shown in FIG. 23 is then performed to detect an effective lowest layer (steps S92 through S95). In step S92 where a transmission attribute is determined, the temporary transmission attribute of the layer the layer number of which is k is used. The transmission attribute of a mask area is taken into consideration in the temporary transmission attribute of the layer the layer number of which is k. When the process shown in FIG. 25 is completed, the effective lowest layer and the temporary transmission attribute of each layer higher than the effective lowest layer are established.

Figure 26:
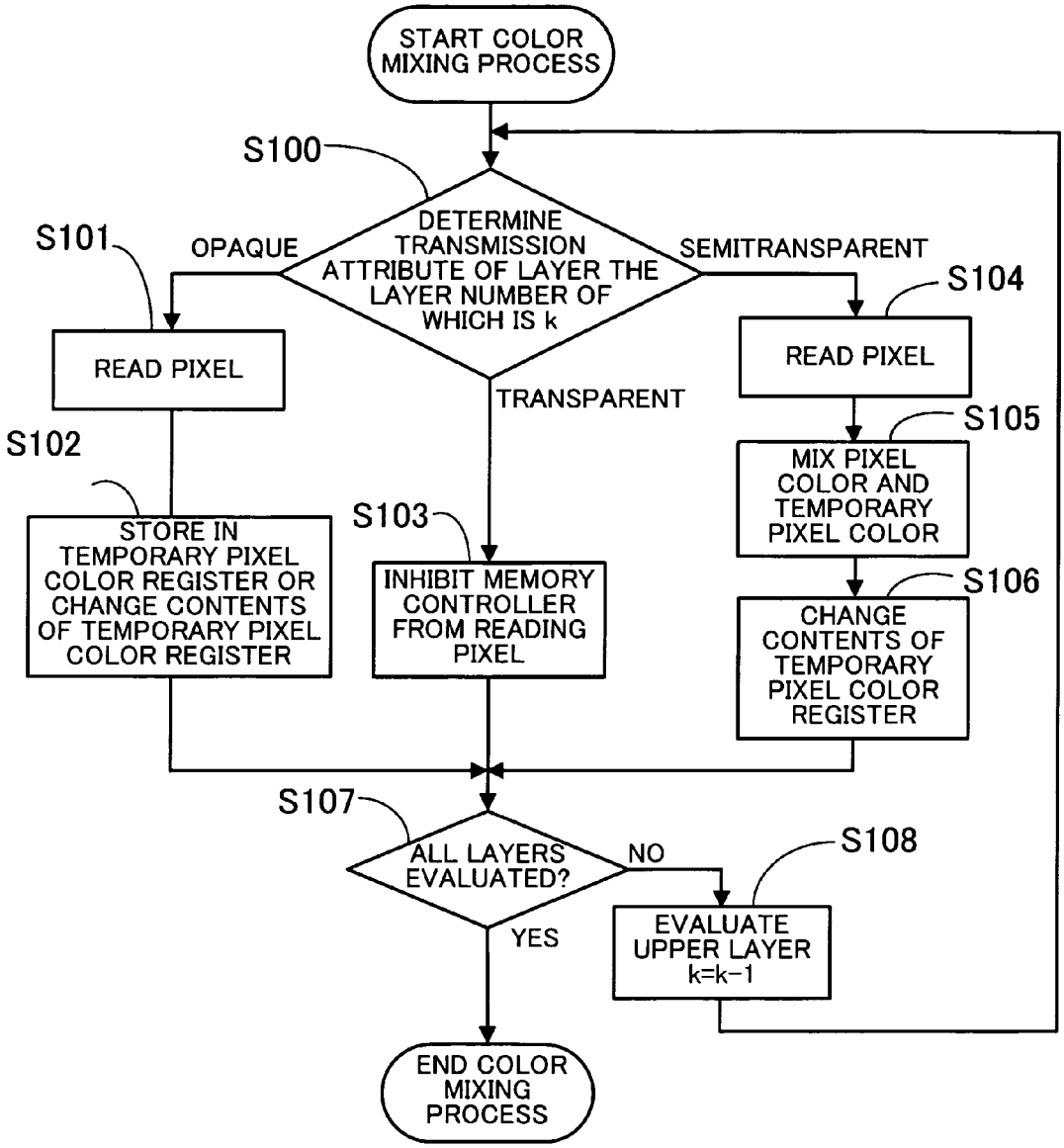
FIG. 26 is a flow chart showing the details of a color mixing process.

FIG. 26 is a flow chart showing the details of the color mixing process.

The color mixing process (steps S100 through S108) shown in FIG. 26 is the same as steps S65 through S73 shown in FIG. 23. In step S100 where a transmission attribute is determined, however, the temporary transmission attribute of a layer the layer number of which is k is used instead of the transmission attribute of the layer the layer number of which is k. The transmission attribute of a mask area is taken into consideration in the temporary transmission attribute of the layer the layer number of which is k.

As stated above, by performing a superposition process by the use of an effective lowest layer and mask areas, memory access to the VRAM 200 can be reduced significantly.

To simplify the descriptions, the process for superimposing the three layers is mainly shown in the above example. Actually, however, more layers may be used.

In the present invention, a memory access mask area which is defined on a frame buffer or a window and to which an independent transmission attribute is assigned is used. When a pixel which is being scanned is in the memory access mask area, a superposition process is performed not by the use of the frame buffer or the window but by the use of the transmission attribute assigned to the memory access mask area. Accordingly, memory access can be limited to only a specific area. As a result, useless memory access can be reduced.

The present invention is applicable to, for example, a car navigation system in which a plurality of windows are superimposed and displayed.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An image processing apparatus for reading image data stored in a plurality of frame buffers each of which corresponds to one layer and for superimposing and displaying the image data, the apparatus comprising:

a first transmission attribute storage section for storing first transmission attributes assigned to the respective frame buffers;

a plurality of temporary transmission attribute storage sections each of which corresponds to each of the plurality of frame buffers;

a mask information storage section for storing mask information for memory access mask areas which are set on at least one of the plurality of frame buffers and are assigned a same second transmission attribute in the image data stored in the plurality of frame buffers, the second transmission attributes being independent of the first transmission attributes;

a mask area inside/outside determination section for determining by reference to information defining the memory access mask area in the mask information whether image data which is being scanned is in one of the memory access mask areas;

an image data read section for reading the image data from the plurality of frame buffers; and a superposition process section for performing a superposition process, wherein the temporary transmission attribute storage sections store only the second transmission attribute assigned to the memory access mask area when it is determined that the image data is in the memory access mask area, and store only the first transmission attribute assigned to the corresponding frame buffer when it is determined that the image data is not in the memory access mask area, and the image data read section reads the image data from the frame buffers corresponding to the temporary transmission attribute storage sections, on the basis of the first transmission attribute or second transmission attribute stored in the temporary transmission attribute storage sections.

2. The image processing apparatus according to claim 1, wherein if the image data which is being scanned is in the memory access mask area and the transmission attribute assigned to the memory access mask area is transparent, the superposition process section inhibits the image data read section from reading the image data which is being scanned.

3. The image processing apparatus according to claim 1, wherein if the image data which is being scanned is in the memory access mask area and the transmission attribute assigned to the memory access mask area is semitransparent, the superposition process section performs the process of mixing a color of the image data which is being scanned and a color of corresponding image data on a frame buffer or a window at a layer just under a layer where the image data which is being scanned belongs.

4. The image processing apparatus according to claim 1, wherein if the image data which is being scanned is in the memory access mask area and the transmission attribute assigned to the memory access mask area is opaque, the superposition process section inhibits the image data read section from reading corresponding image data on a frame buffer or a window at a layer just under a layer where the image data which is being scanned belongs.

5. The image processing apparatus according to claim 1, wherein:

each of the memory access mask areas is a rectangle which is located in parallel with a horizontal coordinate axis and a vertical coordinate axis of a frame buffer or a window and a position and a size of which are defined by horizontal coordinates and vertical coordinates of opposite vertices; and the mask information storage section stores the horizontal coordinates and the vertical coordinates of the opposite vertices.

6. The image processing apparatus according to claim 1, wherein:

a plurality of memory access mask areas are set for a same frame buffer or a same window; and the mask information storage section stores priority of each of the plurality of memory access mask areas set.

7. The image processing apparatus according to claim 6, wherein if at least two of the plurality of memory access mask areas set for the same frame buffer or the same window at least overlap and have different transmission attributes, a transmission attribute of a higher priority memory access mask area is selected as a transmission attribute of a portion where the two memory access mask areas overlap.

8. The image processing apparatus according to claim 1, further comprising:

a superposition order holding section for holding order in which the plurality of frame buffers or the windows are superimposed; and an effective lowest layer detection section for detecting an effective lowest layer according to a transmission attribute of image data at each layer which is being scanned, wherein the image data read section reads image data only from a frame buffer or a window considered to be the effective lowest layer and frame buffers or windows at layers higher than the effective lowest layer.

9. The image processing apparatus according to claim 8, wherein the effective lowest layer detection section refers to the order in which the plurality of frame buffers or the windows are superimposed, determines, in the case of the image data which is being scanned being in the memory access mask area, the transmission attribute assigned to the memory access mask area in order from a highest layer, determines, in the case of the image data which is being scanned being outside the memory access mask areas, a transmission attribute of a frame buffer or a window in order from the highest layer, and sets a first layer a transmission attribute of which is considered to be opaque as the effective lowest layer.

* * * * *